US010118177B2

(12) United States Patent
Burroughs et al.

(10) Patent No.: US 10,118,177 B2
(45) Date of Patent: Nov. 6, 2018

(54) SINGLE COLUMN MICROPLATE SYSTEM AND CARRIER FOR ANALYSIS OF BIOLOGICAL SAMPLES

(71) Applicant: Seahorse Bioscience, Billerica, MA (US)

(72) Inventors: Sarah Burroughs, Auburndale, MA (US); Paul McGarr, Longmeadow, MA (US); Suzanne Armitstead, Bedford, NH (US); Jay S. Teich, Berlin, MA (US); Jason Dell'Arciprete, Billerica, MA (US)

(73) Assignee: SEAHORSE BIOSCIENCE, Billerica, MA (US)

( * ) Notice: Subject to any disclaimer, the term of this patent is extended or adjusted under 35 U.S.C. 154(b) by 0 days.

(21) Appl. No.: 14/728,790

(22) Filed: Jun. 2, 2015

(65) Prior Publication Data

US 2015/0343439 A1 Dec. 3, 2015

Related U.S. Application Data

(60) Provisional application No. 62/006,593, filed on Jun. 2, 2014.

(51) Int. Cl.

| | |
|---|---|
| ***B01L 3/00*** | (2006.01) |
| ***B01L 7/02*** | (2006.01) |
| ***B01L 9/00*** | (2006.01) |

(52) U.S. Cl.

CPC ..... *B01L 3/5085* (2013.01); *B01L 3/50855* (2013.01); *B01L 7/02* (2013.01);
(Continued)

(58) Field of Classification Search

CPC ..... B01L 3/5085; B01L 2300/0829
(Continued)

(56) References Cited

U.S. PATENT DOCUMENTS 4,016,617 A 4/1977 Cardus et al.
4,065,357 A 12/1977 Groves
(Continued)

FOREIGN PATENT DOCUMENTS

DE 4016617 A1 11/1991
DE 4217868 A1 12/1993
(Continued)

OTHER PUBLICATIONS

"Footprint Dimensions", Society for Biomolecular Sciences SBS, ANSI American National Standards Institute, ANSI/SBS Jan. 2004, Jan. 25, 2006.

(Continued)

*Primary Examiner* — Natalia Levkovich

(57) ABSTRACT

A multiwell microplate for holding liquid samples, and a method of use thereof. The multiwell microplate includes a frame defining a plurality of wells disposed in a single column, each well having an opening with a length $l_1$. A moat is disposed about the plurality of wells. A plurality of walls traverses the moat, the walls defining a plurality of compartments, each compartment having a length $l_2$ selected from a range of greater than $l_1$ and less than $6l_1$. A multiwell microplate carrier includes a body defining a plurality of regions configured to hold a plurality of multiwell microplates in parallel, each multiwell microplate defining a single column of wells, and each of the regions defining a plurality of openings that are adapted to mate with the single columns of wells.

13 Claims, 17 Drawing Sheets

(52) U.S. Cl.
CPC ..... *B01L 9/523* (2013.01); *B01L 2200/02* (2013.01); *B01L 2200/028* (2013.01); *B01L 2200/142* (2013.01); *B01L 2300/0627* (2013.01); *B01L 2300/0829* (2013.01); *B01L 2300/0861* (2013.01); *B01L 2300/0893* (2013.01)

(58) Field of Classification Search
USPC ..... 422/552, 503
See application file for complete search history.

(56) References Cited

U.S. PATENT DOCUMENTS 4,217,868 A 8/1980 Grather et al.
4,256,832 A 3/1981 Findl et al.
4,405,375 A 9/1983 Gibson et al.
4,461,328 A 7/1984 Kenney
4,498,510 A 2/1985 Minshew, Jr. et al.
4,599,315 A 7/1986 Terasaki et al.
4,711,851 A 12/1987 McNamara et al.
4,877,659 A * 10/1989 Vince ..... B01L 3/5085 206/558
4,879,097 A 11/1989 Whitehead et al.
5,104,804 A 4/1992 Humphries et al.
5,120,421 A 6/1992 Glass et al.
5,200,051 A 4/1993 Cozzette et al.
5,250,419 A 10/1993 Bernard et al.
5,264,103 A 11/1993 Yoshioka et al.
5,278,048 A 1/1994 Parce et al.
5,286,364 A 2/1994 Yacynych et al.
5,309,085 A 5/1994 Sohn
5,345,213 A 9/1994 Semancik et al.
5,459,300 A 10/1995 Kasman
5,466,348 A 11/1995 Holm-Kennedy
5,468,605 A 11/1995 Harris et al.
5,495,850 A 3/1996 Zuckerman
5,496,697 A 3/1996 Parce et al.
5,512,492 A 4/1996 Herron et al.
5,536,662 A 7/1996 Humphries et al.
5,567,598 A 10/1996 Stitt et al.
5,622,872 A 4/1997 Ribi
5,728,541 A 3/1998 Kornblith
5,766,875 A 6/1998 Hafeman et al.
5,774,214 A 6/1998 Prettyjohns
5,792,426 A 8/1998 Portmann et al.
5,830,138 A 11/1998 Wilson
5,959,297 A 9/1999 Weinberg et al.
5,998,517 A 12/1999 Gentle, Jr. et al.
6,030,917 A 2/2000 Weinberg et al.
6,078,698 A 6/2000 Lorton et al.
6,080,574 A 6/2000 Berndt
6,083,761 A 7/2000 Kedar et al.
6,146,967 A 11/2000 Thakur et al.
D438,631 S 3/2001 Miller
D438,632 S 3/2001 Miller
D438,633 S 3/2001 Miller
6,280,586 B1 8/2001 Wolf et al.
6,306,658 B1 10/2001 Turner et al.
6,376,233 B1 4/2002 Wolf et al.
6,380,605 B1 4/2002 Verhaegen
6,395,506 B1 5/2002 Pitner et al.
6,395,555 B1 5/2002 Wilson et al.
6,416,967 B2 7/2002 Kornblith
6,468,736 B2 10/2002 Brooker
6,486,947 B2 11/2002 Modlin et al.
6,627,158 B1 9/2003 Peltier
6,653,124 B1 11/2003 Freeman
6,673,532 B2 1/2004 Rao
6,766,817 B2 7/2004 da Silva
6,821,787 B2 11/2004 Neilson et al.
6,835,574 B2 12/2004 Neilson et al.
6,880,158 B1 4/2005 Basso et al.
6,881,584 B1 4/2005 Lenhard et al.
6,887,680 B2 5/2005 Kornblith
6,900,027 B1 5/2005 Kornblith
6,918,404 B2 7/2005 Dias da Silva
6,933,129 B1 8/2005 Kornblith
6,990,416 B2 1/2006 Kobalka et al.
7,066,586 B2 6/2006 da Silva
7,265,700 B2 9/2007 Johnstone et al.
7,276,351 B2 10/2007 Teich et al.
7,558,936 B2 7/2009 Beale et al.
7,638,321 B2 12/2009 Teich et al.
7,704,475 B2 4/2010 Bull et al.
7,795,012 B2 9/2010 Lehmann et al.
7,851,201 B2 12/2010 Teich et al.
8,046,183 B2 10/2011 Dobyns et al.
8,202,702 B2 6/2012 Neilson et al.
8,658,349 B2 2/2014 Teich et al.
8,697,431 B2 4/2014 Teich et al.
2001/0039045 A1 11/2001 Chan et al.
2001/0051353 A1 12/2001 Kornblith
2002/0025547 A1 2/2002 Rao
2002/0098592 A1 7/2002 Neilson et al.
2002/0098593 A1 7/2002 Nelson et al.
2002/0132360 A1 9/2002 Neilson et al.
2002/0146345 A1 10/2002 Neilson et al.
2002/0146836 A1 10/2002 Neilson et al.
2002/0168679 A1 11/2002 Naus et al.
2002/0182720 A1 12/2002 Gevaert et al.
2002/0192638 A1 12/2002 Kornblith
2003/0059807 A1 3/2003 Roach et al.
2003/0162285 A1 8/2003 Tajima
2004/0023375 A1 2/2004 Kornblith et al.
2004/0072722 A1 4/2004 Kornblith et al.
2004/0077075 A1 4/2004 Jensen et al.
2004/0086888 A1 5/2004 Kornblith et al.
2004/0107986 A1 6/2004 Neilson et al.
2004/0110301 A1 6/2004 Neilson et al.
2004/0121454 A1 6/2004 Jury et al.
2004/0197905 A1 10/2004 Hafeman
2005/0054028 A1 3/2005 Teich et al.
2006/0051249 A1 3/2006 Knebel et al.
2007/0037285 A1 2/2007 Ehret et al.
2007/0087401 A1 4/2007 Neilson et al.
2008/0014571 A1 1/2008 Teich et al.
2008/0031774 A1 2/2008 Magnant et al.
2010/0227385 A1 9/2010 Teich et al.
2013/0040855 A1 2/2013 Takayama et al.
2014/0186876 A1 7/2014 Teich et al.

FOREIGN PATENT DOCUMENTS

DE 4405375 A1 8/1995
DE 10136005 C1 11/2002
DE 10329983 A1 3/2005
EP 0128438 A2 12/1984
EP 0363262 A1 4/1990
EP 0402917 A2 12/1990
EP 0545284 A1 6/1993
EP 0722136 A2 7/1996
EP 1416041 A1 5/2004
EP 2636452 A1 9/2013
FR 2792333 A1 10/2000
WO WO-8809808 A2 12/1988
WO WO-9308464 A1 4/1993
WO WO-9322678 A2 11/1993
WO WO-94/03583 A1 2/1994
WO WO-9429708 A1 12/1994
WO WO-95/22406 A1 8/1995
WO WO-98/15645 A1 4/1998
WO WO-99/55827 A1 11/1999
WO WO-99/60630 A1 11/1999
WO WO-00032308 A2 6/2000
WO WO-0036410 A1 6/2000
WO WO-0071669 A1 11/2000
WO WO-01/85901 A2 11/2001
WO WO-02/00336 A2 1/2002
WO WO 02/02736 1/2002
WO WO-02/008385 1/2002
WO WO-02/011881 2/2002
WO WO-02/061858 A2 8/2002
WO WO-02/072423 A1 9/2002
WO WO-02/083852 A2 10/2002

(56) References Cited

FOREIGN PATENT DOCUMENTS

| | | | |
|---|---|---|---|
| WO | WO-02/099386 | A2 | 12/2002 |
| WO | WO-03/000557 | A2 | 1/2003 |
| WO | WO-03/004596 | A1 | 1/2003 |
| WO | WO-03/059518 | A1 | 7/2003 |
| WO | WO-04065618 | A2 | 8/2004 |
| WO | WO-04/094060 | A1 | 11/2004 |

OTHER PUBLICATIONS

"How to Adjust pH Levels," in Office Action dated Sep. 28, 2010 in U.S. Appl. No. 11/486,440.
"The Nature of ATP," *ATP and Biological Energy*, (as printed from Internet on Oct. 4, 2005, http://www.emc.maricopa.edu/faculty/farabee/BIOBK/BioBookATP.html).
"Well Positions", Society for Laboratory Automation and Screening SLAS, ANSI American National Standards Institute, ANSI/SBS Apr. 2004 (formerly recognized as ANSI/SBS Apr. 2004), Oct. 13, 2011.
Ainscow et al., "Top-down control analysis of ATP turnover, glycolysis and oxidative phosphorylation in rat hepatocytes," Eur. J. Biochem., 263(3):671-85 (Aug. 1999).
Amano et al., "Measuring respiration of cultured cell with oxygen electrode as a metabolic indicator for drug screening," Human Cell 12(1):3-10 (1999).
Andreescu et al., "Autonomous Multielectrode System for Monitoring the Interations of Isoflavonoids with Lung Cancer Cells," 76 Anal. Chem. 8, pp. 2321-2330 (2004).
Andreescu, S. et al., "Advanced electrochemical sensors for cell cancer monitoring," Methods, vol. 37 pp. 84-93 (2005).
B. Cunningham, P. Li, B. Lin, J. Pepper, "Colorimetric resonant reflection as a direct biochemical assay technique," Sensors and Actuators B, vol. 81, p. 316-328, Jan. 5, 2002.
Beebe D.J., Mensing G.A., Walker G.M. (2002) "Physics and applications of microfluidics in biology." Annu. Rev. Biomed. Eng., 4, 261-86.
Beebe D.J., Moore J.S., Bauer J.M., Yu Q., Liu R.H., Devadoss, C., Jo B.H. (2000) Functional hydrogel structures for autonomous flow control inside microfluidic channels. Nature, 404, 588-90.
Bousse, L., Cohen, C., Nikiforov, T., Chow, A., Kopf-Sill, A.R., Dubrow, R. and Parce, J.W. (2000) "Electrokinetically Controlled Microfluidic Analysis Systems." Annu. Rev. Biophys. Biomol. Struct. 29, 155-181.
Brecht & Gauglitz, "Optical probes and transducers," Biosensors and Bioelectronics, 10, p. 923-936, 1995.
Burd et al., "Tumor oxygenation and acidification are increased in melanoma xenografts after exposure to hyperglycemia and meta-iodo-benzylguanidine," Rediation Research 159:328-335 (2003).
Buttgereit et al., "A hierarchy of ATP-consuming processes in mammalian cells," Biochem. J., Nov. 15, 1995;312 (Pt 1):163-7.
Clark, L.C. Jnr. Ann. NY Acad. Sci. 1962; 102:29-45.
Criddle et al. "Simultaneous Measurement of Metabolic Heat Rate, CO2 Production, and O2 Consumption by Microcalorimetry" Analytical Biochem. 1991, 194:413-417.
De Beer, Dirk, "Micro-Electrodes." Immolilized Cells, Chapter 10 2001, 85-100.
Deshpande et al., "Microplates with integrated oxygen sensing for medium optimization in animal cell culture," Cytotechnology 46:1-8 (2004).
Ekelund et al., "Microphysiometry: new technology for evaluation of anticancer drug activity in human tumor cells in vitro," Anti-Cancer Drugs 9:531-538 (1998).
Examination Report dated Aug. 31, 2012 for European Patent Application No. 04788615.5 filed Sep. 8, 2004, 4 pages.
Extended European Search Report from EP Application No. 10184182.3.
Ferguson et al. "Simultaneous monitoring of pH, CO2, and O2 using an optical imaging fiber" Analytica Chemica Acta, 1997, 340: 123-131.
Flora K and J Brennan, "Comparison of Formats for the Development of Fiber-Optic Biosensors Utilizing Sol-Gel Derived Materials Entrapping Fluorescently-Labeled Proteins." Analyst, 1999, 124, 1455-1462.
Gatti et al., "Oxygen microoptodes: a new tool for oxygen measurments in aquatic animal ecology," Marine Biology, 2002, 140:1075-1085.
Ge X, Kostov Y, and G Rao. High Stability non-invasive autoclavable naked optical CO2 sensor. 2003. Biosensor and Bioelectronics 18:pp. 857-865.
Gesinski RM, Morrison JH, Toepfer JR. "Measurement of oxygen consumption of rat bone marrow cells by a polarographic method." *J Appl Physiol*. 1968; 24(6):751-754.
Gump et al., "TAT transduction: the molecular mechanism and therapeutic prospects," Trends Mol. Med., 13(10):443-48 (2007).
Guppy, J. Cell Phys. 170:1-7 (1997).
Handbook of Fluorescent Probes and Research Products published by Molecular Probes, Inc., Eugene, Oregon, USA, http://www.probes.com/handbook/ (accessed Mar. 12, 2004), Table of Contents, 2 pages.
Hasselbrink E.F. Jr., Shepodd T.J., Rehm J. (2002) "High-pressure microfluidic control in lab-on-a-chip devices using mobile polymer monoliths." Anal. Chem. 74, 4913-18.
Hua S.Z., Sachs F., Yang D.X., Chopra H.D. (2002) "Microfluidic actuation using electrochemically generated bubbles." Anal. Chem. 74, 6392-96.
Huber et al., "Direct optical immunosensing (sensitivity and selectivity)," Sensors and Actuators B, 6, p. 122-126, 1992.
International Preliminary Report on Patentability for PCT/US2004/029163, dated Dec. 15, 2005, 15 pages.
International Preliminary Report on Patentability for PCT/US2007/013998, dated Jan. 22, 2009, 12 pages.
International Preliminary Report on Patentability in PCT/US2013/069839 dated May 28, 2015 8 pages.
International Search Report and Written Opinion for PCT/US2004/029163, dated Mar. 2, 2005, 8 pages.
International Search Report and Written Opinion for PCT/US2007/013998, dated Apr. 8, 2008, 14 pages.
International Search Report and Written Opinion for PCT/US2013/069839, dated Jun. 3, 2014, 9 pages.
International Search Report for International Application No. PCT/US03/38294, dated Apr. 2004.
Invitation to Pay Additional Fees & Partial Internation Search for International Application No. PCT/US2007/013998, dated Feb. 1, 2008.
Isao Karube, "Microbial Sensor", Journal of Biotechnology, 15, (1990), pp. 255-266.
Jekabsons et al., "Bioenergetic analysis of cerebellar granule neurons undergoing apoptosis by potassium/serum deprivation," Cell Death Differ. 13(9):1595-610 (Sep. 2006) (Epub Jan. 20, 2006).
Jin et al., "A biosensor concept based on imaging ellipsometry for visualization of biomolecular interactions," Analytical Biochemistry, 232, p. 69-72, 1995.
Jordan & Corn, "Surface Plasmon Resonance Imaging Measurements of Electrostatic Biopolymer Adsorption onto Chemically Modified Gold Surfaces," Anal. Chem., 69:1449-1456 (1997).
Karasinski, J. et al., "Detection and identification of bacteria using antibiotic susceptibility and a multi-array electrochemical sensor with pattern recognition," Biosensors and Bioelectronics, vol. 22, pp. 2643-2649 (2007).
Klaus Riedel et al., "Microbial Sensors: Fundamentals and Application for Process Control", J. Chem. Tech. Biotechnol. 44, (1989), pp. 85-106.
Kraus et al. "Biosensing with Cellular Systems", Bioscope, 1, pp. 24-33, 1993.
Lehmann, M, Baumann W, Brischwein M, Gahle H-J, Freund I, Ehret R, Dreschler S, Palzer H, Kleintges M, Sieben U and Wolf B. "Simultaneous measurement of cellular respiration and acidification with a single CMOS ISFET. 2001." Biosensors & Bioelectronics. 2001;16:195-203.
Linder, V., Sia, S., and Whitesides, G. "Reagent-Loaded Cartridges for Valveless and Automated Fluid Delivery in Microfluidic Devices." American Chemical Society 2005; 77(1):64-71.

(56) References Cited

OTHER PUBLICATIONS

Lou et al., "Mitochondrial uncouplers with an extraordinary dynamic range," Biochem J., 407(1):129-40 (Oct. 2007).
Ländesmäki I, Scampavia LD, Beeson C, and Ruzicka J. "Detection of Oxygen Consumption of Cultured Adherent Cells by Bead Injection Spectroscopy." *Anal. Chem*. 1999; 71: 5248-5252.
Maharbiz et al., "Silicon microbial bioreactor arrays," Poster 83, 1st Annual International IEEE—EMBS Special Topic Conference on Microtechnologies in Medicine & Biology, Oct. 12-14, Lyon, France.
McConnell, H.M., Owicki, J.C., Parce, J.W., Miller, D.L., Baxter, G.T., Wada, H.G. and Pitchford, S. (1992) "The Cytosensor Microphysiometer: Biological Applications of Silicon Technology" Science 257: 1906.
Metzger, R., Deglmann, C.J., Hoerrlein, S., Zapf, S. and Hilfrich, J. (2001) Toxicology 166, 97-108.
Morhard et al., "Immobilization of antibodies in micropatterns for cell detection by optical diffraction," Sensors and Actuators B, 70, p. 232-242, 2000.
Motterlini et. al., "Depression of Endothelial and Smooth Muscle Cell Oxygen Consumption by Endotoxin," American Journ. of Physio. vol. 275, No. 168 p. 776-782, Sep. 1998.
O'Riordan TC, Buckley D., Ogurtsov V, O'Connor R., Papkovsky DB "A cell viability assay based on monitoring respiration by optical oxygen sensor." *Anal. Biochem*. 2000; 278(2):221-227.
Office Action in Chinese Patent Application No. 200480029825, dated Jul. 18, 2008.
Office Action in Chinese Patent Application No. 200480029825, dated Nov. 28, 2008 (translation).
Office Action in Chinese Patent Application No. 200780031522.6, dated Feb. 1, 2011.
Office Action in Chinese Patent Application No. 200780031522.6, dated Jul. 15, 2010 (translation).
Office Action in Chinese Patent Application No. 200780031522.6, dated Jul. 29, 2011 (translation).
Office Action in Indian Patent Application No. 1170/DELNP/2006, dated Oct. 6, 2008 (translation).
Official Action in European Patent Application No. 04788615.5-1234, dated Mar. 12, 2008, 4 pages.
Official Action in European Patent Application No. 04788615.5-1234, dated Sep. 8, 2010, 6 pages.
Owicki, J.C., Bousse, L.J., Hafeman, D.G., Kirk, G.L., Olson, J.D., Wada, H.G. and Parce, J.W. (1994) "The Light-Addressable Potentiometric Sensor: Principles and Biological Applications." Ann. Rev. Biophys. Biomol. Struct. 23: 87-113.
Paitan et al., "Monitoring Aromatics Hydrocarbons by Whole Cell Electrochemical Biosensors," Analytical Biochemistry, 335:175-183 (2004).
Panten U and Klein H. "O2 consumption by isolated pancreatic islets, as measured in a Microincubation system with a Clark-type electrode." Endocrinology 1982; 111:1595-1600.
Parce W, Owicki J, Kercso K, Sigel G, Wada H, Muir V, Bousse L, Ross K, Sikic B, and McConnell H. 1989. "Detection of Cell-Affecting Agents with a Silicon Biosensor." Science. 1989; 246(4927):243-247.
Pattison R, Swamy J, Mendenhall B, Hwang C, and Frohlich B. "Measurement and Control of Dissolved Carbon Dioxide in Mammalian Cell Culture Processes Using an in Situ Fiber Optic Chemical Sensor." 2000. Biotechnology Prog. 16:769-774.
Pouli, A.E., Karagenc, N., Arden, S., Bright, N., Schofield, G.S., Hutton, J.C. & Rutter, G.A. (1998) "A phogrin-aequorin chimaera to image Ca2+ in the vicinity of secretory granules." Biochem. J., 330, 1399-1404.
Prokop et al., "NanoLiterBioReactor: long-term mammalian cell culture at nanofabricated scale," Biomedical Microdevices 6(4):325-339 (2004).
Robiolio et al., "Oxygen diffusion and mitochondrial respiration in neuroblastoma cells," Am. J. Physiol. 256 (6 Pt 1):C1207-1213 (Jun. 1989).
Rumsey et al., "Cellular Energetics and the Oxygen Dependence of Respiration in Cardiac Myocytes Isolated from Adult Rat" Journal of Biological Chemistry. 265(5):15392-15399. 1990.
Scott et al., "Energy transduction in intact synaptosomes. Influence of plasma-membrane depolarization on the respiration and membrane potential of internal mitochondria determined in situ," Biochem. J. 186(1):21-33 (Jan. 1980).
Seaver et al. "Hydrogen Peroxide Fluxes and Compartmentalization inside Growing *Eschericha coli*" J. Bacteriol., 2001, 183: 7182-7189.
Shenoy MA, Biaglow JE, Varnes ME, Hetzel FW. "Inhibition of cultured human tumor cell oxygen utilization by chlorpromazine." Adv Exp Med Biol.1983;159:359-68.
Terada, "Uncouplers of oxidative phosphorylation," Environ. Health Perspect., 87:213-18 (1990).
Thorsen, T., Maerkl, S.J. and Quake, S.R. (2002) Microfluidic Large-Scale Integration Science 298, 580-586.
Tolosa L, Kostov Y, Harms P, Rao G. "Noninvasive measurement of dissolved oxygen in shake flasks." Biotechnol Bioeng Dec. 5, 2002;80(5):594-97.
Unger, M.A., Chou, H-P, Thorsen, T., Scherer, A, and Quake, S.R. (2000) Science 288, 113-116.
Van der Gun et al., "Serum insensitive, intranuclear protein delivery by the multipurpose cationic lipid SAINT-2," J. Control Release, 123:228-238 (2007).
Vanderkooi et. al., "An Optical Method for Measurement of Dioxygen Concentration Based upon Quenching of Phosphorescence, " J. Biol. Chem., 262 (12):5476-5482 (Apr. 1987).
Wada, H.G. Indelicato, S.R., Meyer, L. Kitamura, T., Miyajima, A., Kirk, G., Muir, V.C. and Parce, J.W. (1993) "GM-CSF Triggers a Rapid Glucose Dependent Extracellular Mediated Activation of Acid Production." J. Cell Physiol. 154: 129-138.
Wiley, C and Beeson, C. (2002) "Continuous measurement of glucose utilization in heart myoblasts." Analytical Biochemistry 304, 139-146.
Wilson et al., "The Oxygen Dependence of Mitochondrial Oxidative Phosphorylation Measured by a New Optical Method for Measuring Oxygen Concentration," J. Biol. Chem., 263:2712-2718 (1988).
Wodnicka M, Guarino RD, Hemperly JJ, Timmins MR, Stitt D, Pitner JB. "Novel fluorescent technology platform for high throughput cytotoxicity and proliferation assays." Journal of Biomolecular Screening. 2000; 5:141-152.
Wolfbeis OS, 2002. "Fiber-Optic Chemical Sensors and Biosensors." *Annal of Chem*. 2002; 74:2663-2678.
Y.I. Korpan et al., "A Cell Biosensor Specific for Formaldehyde Based on pH-Sensitive Transistors Coupled to Methylotrophic Yeast Cells with Genetically Adjusted Metabolism", Analytical Biochemistry, 215, (1993), pp. 216-222.
Yang et al., "Reversible and repeatable linear local cell force response under large stretches," Experimental Cell Research, Apr. 2005, 305:42-50.
Yicong et al., "Drug evaluations using a novel microphysiometer based on cell-based biosensors", Sensors & Actuators B 80:215-221 (2001).
Haber et al., "Flow Sensor Driven Nanodispensing: The Path to More Reliable Liquid Handling Operations", American Laboratory, Oct. 2004, pp. 32-36.
Zibin et al., Design of WBDSO Control Circuit With State Machine, May 30, 2005, pp. 1177-1180, Chengdu, Sichuan, China.
International Search Report and Written Opinion in PCT/US2015/033815, dated Sep. 9, 2015, 10 pages.

* cited by examiner

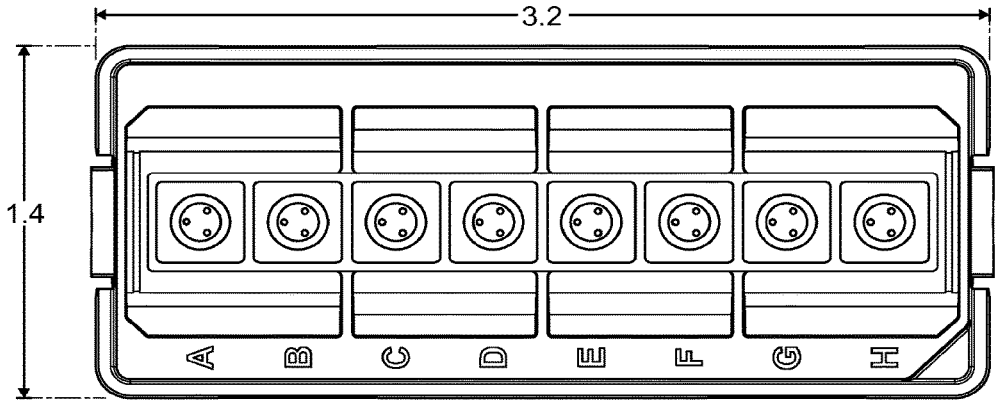
FIG. 1C1
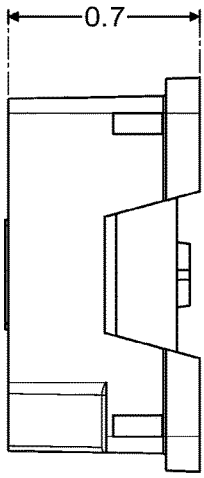
FIG. 1C2
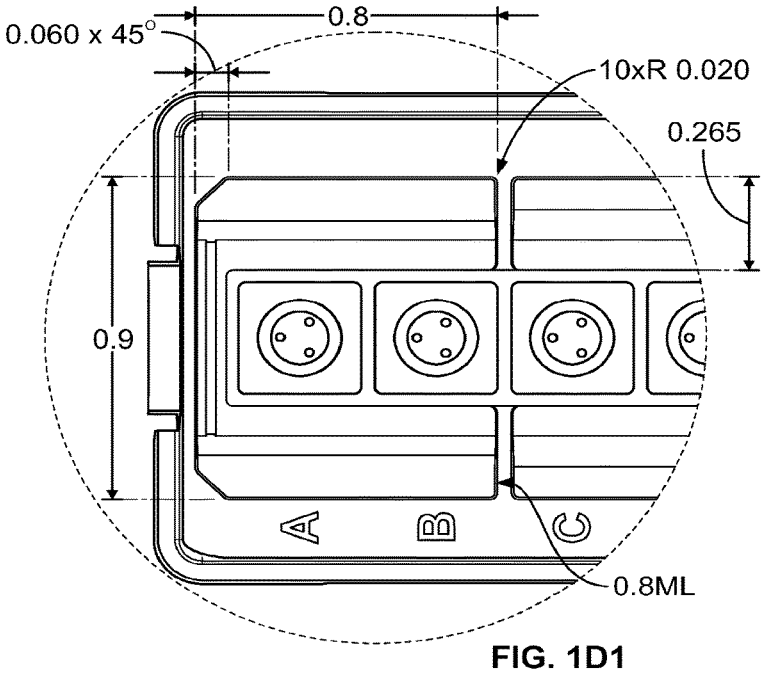
FIG. 1D1

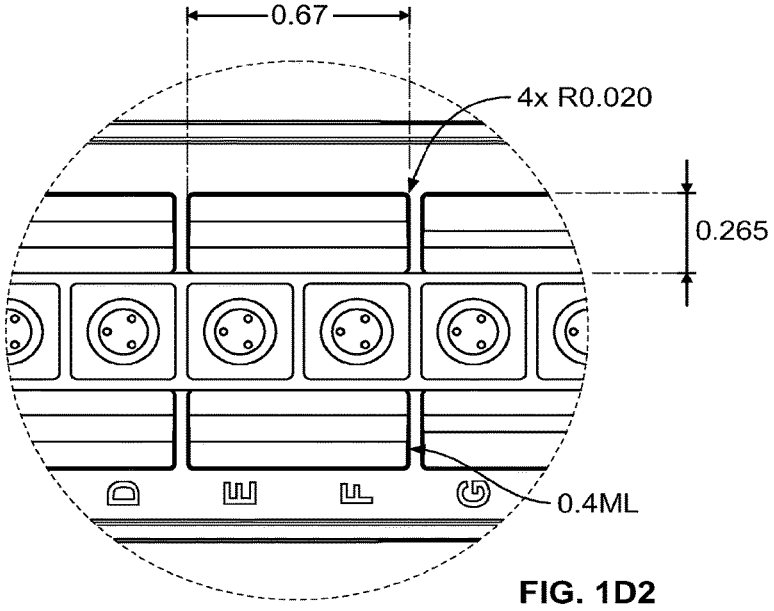
FIG. 1D2
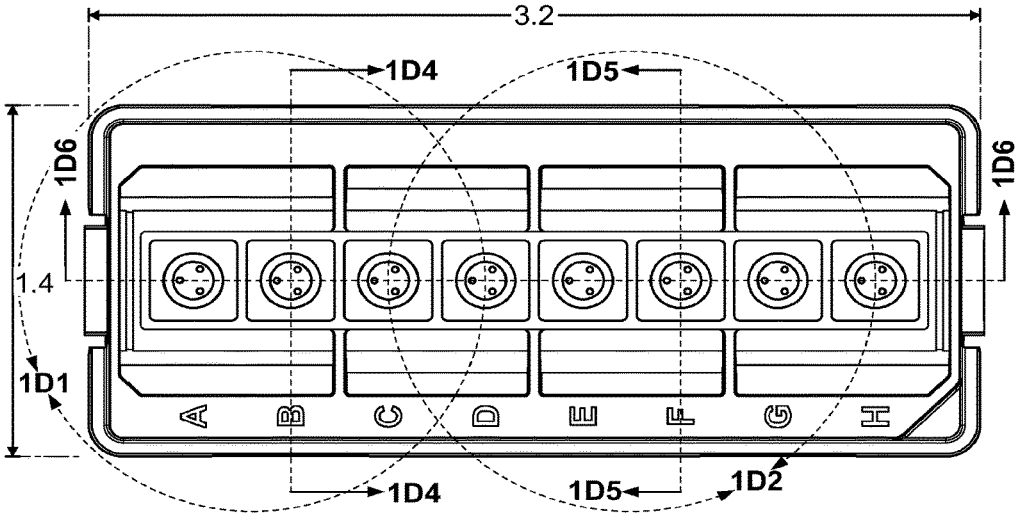
FIG. 1D3

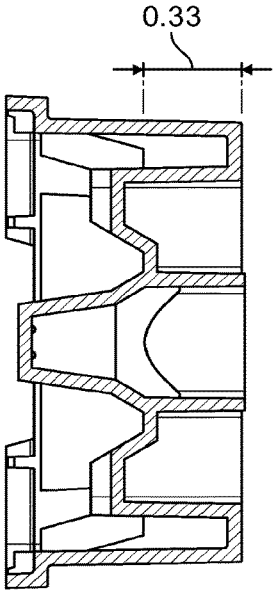
FIG. 1D4
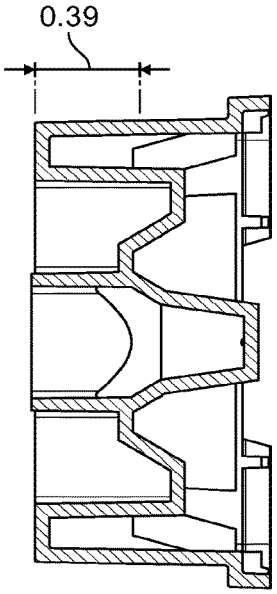
FIG. 1D5
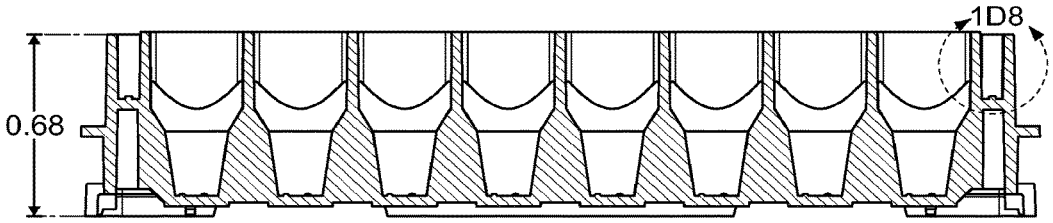
FIG. 1D6

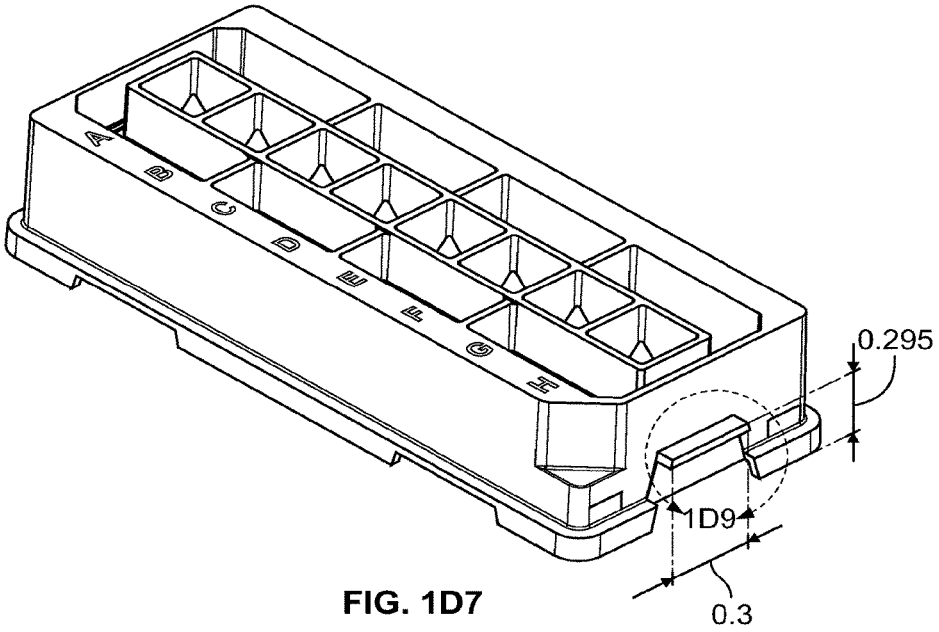
FIG. 1D7
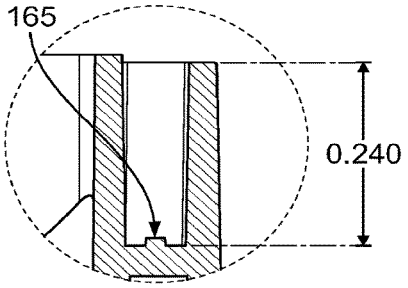
FIG. 1D8
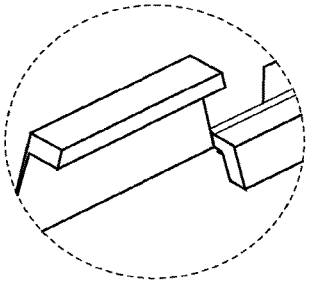
FIG. 1D9

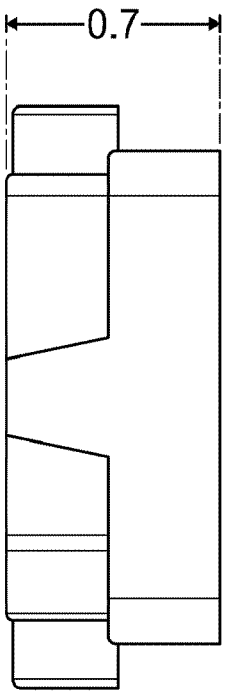
FIG. 2C2
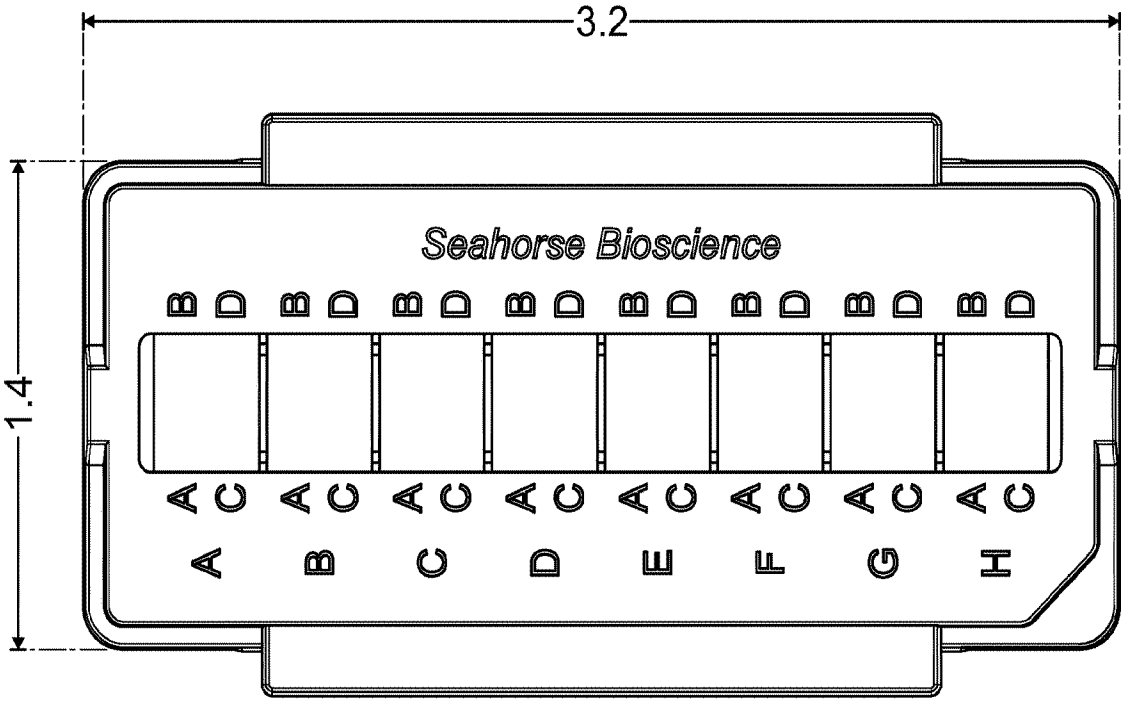
FIG. 2C1

Media Runs with and without moats

OCR baseline rates

| | Plates 1,3,5 (w/o Moats) | | | Plates 2,4,6 (w/ Moats) | | |
|---|---|---|---|---|---|---|
| | 1 | 3 | 5 | 2 | 4 | 6 |
| A | -10.03 | -10.68 | -9.93 | -10.04 | -8.86 | -9.89 |
| B | 0.73 | -1.35 | -2.33 | -4.15 | -6.16 | -5.37 |
| C | -7.56 | -17.28 | -8.55 | -10.82 | -6.52 | -10.47 |
| D | -10.91 | -13.22 | -12.87 | -13.41 | -11.81 | -10.42 |
| E | -15.02 | -27.70 | -23.28 | -18.04 | -13.76 | -10.60 |
| F | -0.28 | -7.73 | -8.08 | -10.72 | -7.11 | -8.70 |
| G | -12.30 | -18.69 | -4.45 | -8.94 | -4.66 | -6.66 |
| H | -8.32 | -9.30 | 3.15 | -6.05 | 1.66 | -9.47 |
| Avg | -7.96 | -13.24 | -8.29 | -10.27 | -7.15 | -8.95 |
| CV | 70% | 60% | 94% | 42% | 65% | 22% |

ECAR baseline rates

| | Plates 1,3,5 (w/o Moats) | | | Plates 2,4,6 (w/ Moats) | | |
|---|---|---|---|---|---|---|
| | 1 | 3 | 5 | 2 | 4 | 6 |
| A | 1.32 | 1.28 | 1.11 | 0.99 | 1.13 | 1.32 |
| B | 1.57 | 1.28 | 1.01 | 0.82 | 1.28 | 0.94 |
| C | 1.30 | 0.99 | 0.85 | 0.98 | 2.01 | 1.29 |
| D | 1.26 | 1.08 | 1.05 | 0.80 | 1.46 | 1.62 |
| E | 2.01 | 1.75 | 1.58 | 1.43 | 1.55 | 1.70 |
| F | 2.33 | 2.23 | 2.10 | 2.19 | 2.43 | 2.11 |
| G | 1.53 | 1.49 | 1.23 | 1.31 | 1.57 | 1.36 |
| H | 1.95 | 1.60 | 1.90 | 2.05 | 1.53 | 1.40 |
| Avg | 1.66 | 1.46 | 1.35 | 1.32 | 1.62 | 1.47 |
| CV | 24% | 28% | 34% | 41% | 26% | 24% |

FIG. 7

Mito Stress Tests, Run With and Without Moats Filled

SINGLE COLUMN MICROPLATE SYSTEM AND CARRIER FOR ANALYSIS OF BIOLOGICAL SAMPLES

RELATED APPLICATION

This application claims the benefit of priority to U.S. Provisional Application Ser. No. 62/006,593 filed Jun. 2, 2014, which is incorporated herein by reference in its entirety.

FIELD OF THE INVENTION

This invention relates generally to devices that measure properties of fluids within vessels, and particularly to microplates and carriers for handling test fluids.

BACKGROUND

In the field of cell analysis, cells are commonly placed in a multiwell microplate for purposes of testing multiple conditions and replicates in a single experiment. Standard microplates, such as 24- and 96-well plates, are two-dimensional arrays of wells. Such arrays include some wells that are at the border or edge of the array, i.e., in the first row, first column, last row, or last column. Border wells and non-border wells can experience different conditions; this is commonly known as an "edge effect". Because such assays are typically conducted at mammalian body temperature (37° C.), and border wells are more exposed to the external environment, the environment within the border wells may be substantially different from that of the non-border wells. The evaporation of liquid from wells adjacent to the border of the plate occurs at a higher rate than that of non-border wells. This causes a temperature drop in the border wells due to evaporative cooling, resulting in an increase in the concentration of solutes in the liquid. Both the temperature differences and the concentration difference contribute to data inconsistency in these types of assays. Live-cell assays are particularly sensitive to these effects due to the dynamic nature of the assay and the sensitivity of living, metabolically active cells to the environmental conditions in which they are being measured. Examples of these types of assays include FLIPR calcium flux assays, Corning EPIC label-free assays, and certain high-content imaging assays.

Several solutions have been proposed and applied to such standard microplates to address this problem. One workaround is to sacrifice the use of the border wells in the assay. By simply filling them with fluid to the same height as the assay wells, the border wells provide a humidity buffer. This approach has serious drawbacks in that the capacity of the microplate is significantly diminished, and in the case of a 24-well plate more than half of the wells are sacrificed. As the size of the well array in the microplate decreases, a higher fraction of wells become border wells. At the extreme, in one-dimensional arrays, every well has a high rate of evaporation.

Another workaround is to seal the wells or plate by overlaying the assay wells with oil or wrapping the covered plate with a plastic paraffin film, such as Parafilm M® film available from Bemis Company, Inc., or similar material. One of the drawbacks to these methods is that gas exchange is reduced. Metabolically active cells require oxygen; thus restricting the supply of oxygen can be detrimental to the cells and cause changes in assay results.

Existing solutions to this problem include modifications to the instrumentation or the cell growth vessel, i.e., microplate and cover. A few instrumentation manufacturers attempt to mitigate these effects by putting humidity control into the measuring chambers in which the microplate is placed. In general, however, these options are rare as high humidity levels can cause problems with the instrument electronics.

Modifications to the cell growth vessel may include changes to the design of the microplate and lid. Changes to the lid include adding a moisture-holding layer to the lid. However, in the case of live-cell assays where addition of reagent during the course of the assay is required, a lid or cover cannot be used.

The addition of perimeter or border wells to the microplate provides an environmental buffer between the assay well and the ambient laboratory conditions. For example, a plate may have large edge troughs, e.g., four troughs, surrounding the array of wells. Fluid may be placed in each trough, thus providing an environmental buffer. A potential drawback of this design is the large volume of each trough. Because well plates are shallow, there is potential sloshing of the border fluid when the plate is tilted or moved around the laboratory. In addition, the depth of the troughs, being the same depth as that of the wells, may require that a significant amount of fluid, more than 10× the volume of the assay well, be added to each trough. Therefore the operator may need to use a different tool (such as a different volume pipet) to fill the border troughs and the assay wells.

Standard microplate designs include a lid or cover where the edge or skirt of the cover can be up to half the height of the plate itself and protrudes 1-2 millimeters ("mm") beyond the wall of the plate. This may present a problem while handling these plates, as it takes some dexterity to consistently pick up both the plate and the lid off of a surface, e.g., to avoid accidentally picking up only the lid and thus exposing the contents of the plate. When dealing with cell cultures that must be maintained under sterile conditions, current plate and cover assembly designs introduce considerable risk to the integrity of the cultures. Similar risks apply to assays where the contents of the wells must be protected from ambient light.

Standard microplate designs have a fixed height and footprint, such that the volume of the wells varies with the number of wells arrayed in the plate. For example, a standard 384-well plate has four times as many wells as a standard 96-well plate, but each well is approximately one-fourth the volume. Likewise, as well density (i.e., wells per plate) goes down, the volume per well increases. This design, although convenient for maintaining a standard footprint, requires that the researcher use more cells and reagents per well when using a lower-density plate. In addition, the spacing between wells changes, which can be an inconvenience when adding reagents to the assay plate.

Presently, no microplate is commercially available for performing an assay on a fewer number of wells while maintaining standard volumes and well-to-well spacing. Maintaining these features and reducing the number of wells may require reducing the footprint. However, since many standard laboratory workflows and instruments are designed to this standard, an adapter or carrier of some sort would be required. Examples of instruments that accept standard-footprint microplates include plate readers, high content imaging systems, centrifuges, and automated plate handling robots.

Microscope slides adhere to a different standard in the lab, and some products exist that bridge the microplate and slide formats. Some commercially available slides contain assay wells fused to a glass microscope slide, providing assay wells with glass bottoms designed for high-resolution imaging on microscopes. Although they do provide wells, the dimensions of the wells vary and are not standard with respect to well-to-well spacing nor length and width dimensions.

A commercially available carrier for microscope slides that conforms to the Society for Laboratory Automation and Screening ("SLAS") microplate footprint and height standards is designed for imaging applications, but the placement of the slides in the carrier allows for some variability in well position, which may make automated analysis challenging.

SUMMARY

In an aspect, an embodiment of the invention may include a multiwell microplate for holding liquid samples. The multiwell microplate includes a frame defining a plurality of wells disposed in a single column, each well having an opening with a length $l_1$; a moat disposed about the plurality of wells; and a plurality of walls traversing the moat. The walls define a plurality of compartments, each compartment having a length $l_2$ selected from a range of greater than $l_1$ and less than $6l_1$.

One or more of the following features may be included. The well length $l_1$ may be selected from a range of 1 mm to 9 mm (0.04 to 0.35 in). The plurality of wells may include eight wells. The moat may include eight compartments.

Two compartments disposed on opposing sides of the single column of wells may be in fluidic communication via an equalizer channel. A depth of the two compartments in communication via the equalizer channel may be less than a depth of compartments adjacent thereto.

A depth of at least one compartment may be less than a depth of one of the wells, e.g., the depth of the at least one compartment may be up to 50% of the depth of one of the wells. A depth of a compartment proximate an end portion of the frame may be less than a depth of a compartment disposed at a center portion of the frame. All of the compartments may have a substantially equal length.

A lifting tab may be defined on an end portion of the frame. At least one well may be opaque white or opaque black. The frame may define an indent on a lower edge.

In another aspect, embodiments of the invention may include a multiwell microplate carrier including a body defining a plurality of regions configured to hold a plurality of multiwell microplates in parallel, each multiwell microplate defining a single column of wells, and each of the regions defining a plurality of openings adapted to mate with the single columns of wells.

One or more of the following features may be included. The body may have a base footprint with outside dimensions of approximately 5 inches by 3.4 inches. Each region may define eight openings. The body may define three or four regions configured to hold three or four multiwell microplates, respectively.

In yet another aspect, embodiments of the invention may include a cartridge for mating with the multiwell microplate described herein. The cartridge includes a substantially planar surface having a plurality of regions corresponding to a number of respective openings of the wells in the multiwall microplate. Also located in plural respective regions of the cartridge is a sensor or a portion of a sensor adapted to analyze a constituent in a well and/or an aperture adapted to receive a sensor. At least one port may be formed in the cartridge, the port being adapted to deliver a test fluid to a respective well of the plate. The multiwell microplate may include eight wells and the cartridge may include eight regions.

In still another aspect, embodiments of the invention include a method for preparing a liquid analytical sample. The method includes delivering the analytical sample to a well defined by a frame of a multiwell microplate. A fluid is delivered to a moat defined by the frame. The frame defines a plurality of wells disposed in a single column, each well having an opening with a length $l_1$. The moat is disposed about the plurality of wells. A plurality of walls traverses the moat, the walls defining a plurality of compartments, each compartment having a length $l_2$ selected from a range of greater than $l_1$ and less than $6l_1$.

One or more of the following features may be included. Delivering the analytical sample to the well may include using a pipettor. Delivering the fluid to the moat may include using a pipettor.

BRIEF DESCRIPTION OF FIGURES

FIG. 1*c* are mechanical drawings of a top view and an end view of a multiwell microplate in accordance with an embodiment of the invention, in which FIG. 1*c*1 is a top view and FIG. 1*c*2 is an end view;

FIG. 1*d* are mechanical drawings of various views of a multiwell microplate in accordance with one embodiment of the invention, in which FIGS. 1*d*1-1*d*2 are top views of shallow and deep moats, respectively, FIG. 1*d*3 is a top view of a multiwell microplate, FIG. 1*d*4-1*d*6 are cross-sectional views of the multiwell microplate of FIG. 1*d*3, FIG. 1*d*7 is a perspective view of a multiwell microplate, and FIGS. 1*d*8-1*d*9 are cross-sectional views of the multiwell microplate of FIG. 1*d*7;

FIG. 2*c* are mechanical drawings of top and end views of a cartridge in accordance with one embodiment of the invention, in which FIG. 2*c*1 is a top view and FIG. 2*c*2 is an end view;

FIG. 3 is a perspective view of a cartridge mated with a multiwell microplate in accordance with an embodiment of the invention;

FIG. 4 is a perspective view of a cover for the multiwell microplate and cartridge of FIG. 3 in accordance with an embodiment of the invention;

FIG. 6 is a bar chart illustrating the impact on fluid loss with a microwell plate having a moat in accordance with an embodiment of the invention;

FIG. 7 is a table illustrating sensitivity of measurement to temperature variations that may be due to varying rates of evaporation in assay wells not protect by fluid-filled moats in accordance with an embodiment of the invention;

DETAILED DESCRIPTION

Evaporation from peripheral wells of a multiwell microplate may have a negative impact on various analytical steps, including cell seeding, cell plate incubation and running assays. In particular, cell-based assays ("CBA") with adherent cells are susceptible to edge effects from cell seeding and cell plate incubation. Live-cells assays such as label-free and extracellular flux ("XF") measurements are also susceptible to edge effects during the running of the assays. Multiwell plate designs having moats with compartments to hold hydration fluid, e.g., water or cell media, at and/or near the edges of the multiwell plate, in accordance with embodiments of the invention, help reduce such edge effects, reducing the evaporation of fluid from the wells by providing a humidified buffer between the air above the wells and the drier air outside a perimeter of the plate.

Figure 1A:
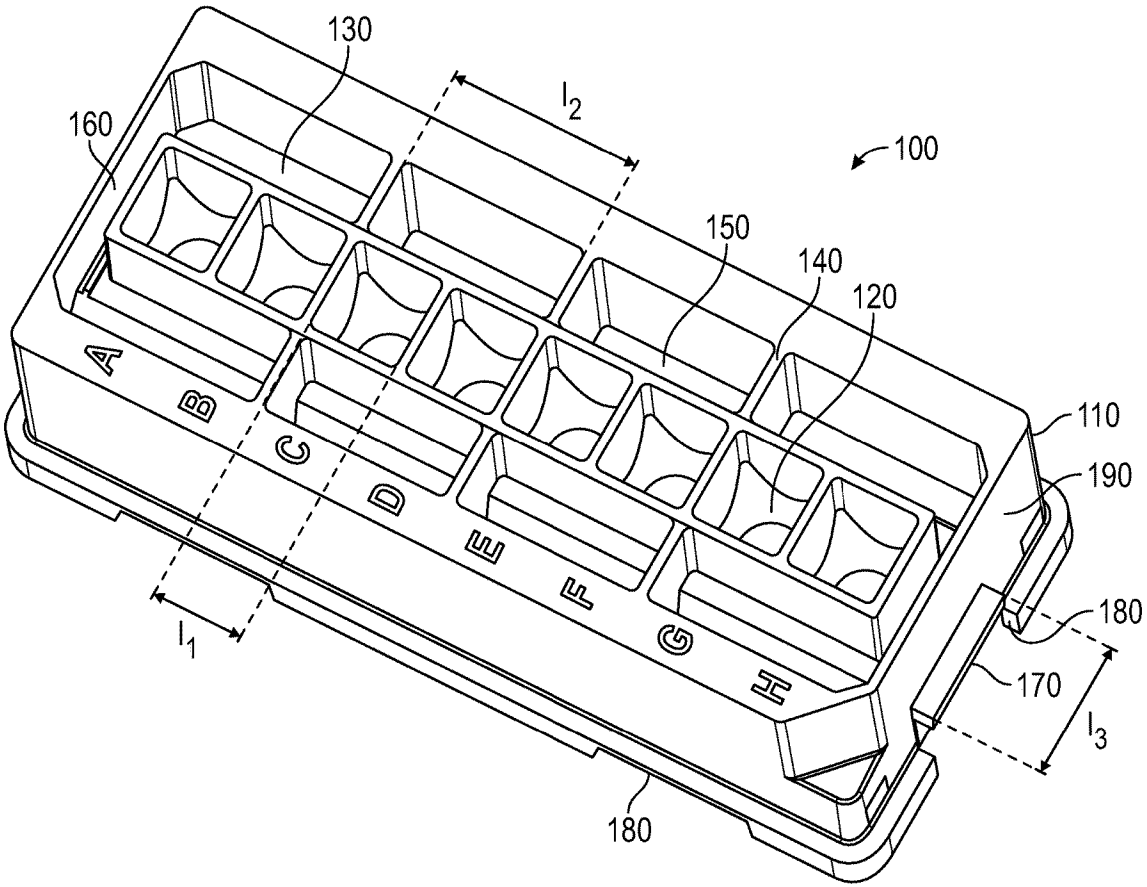
FIGS. 1*a* and 1*b* are upright and inverted (respectively) perspective views of a multiwell microplate in accordance with one embodiment of the invention.
Figure 1B:
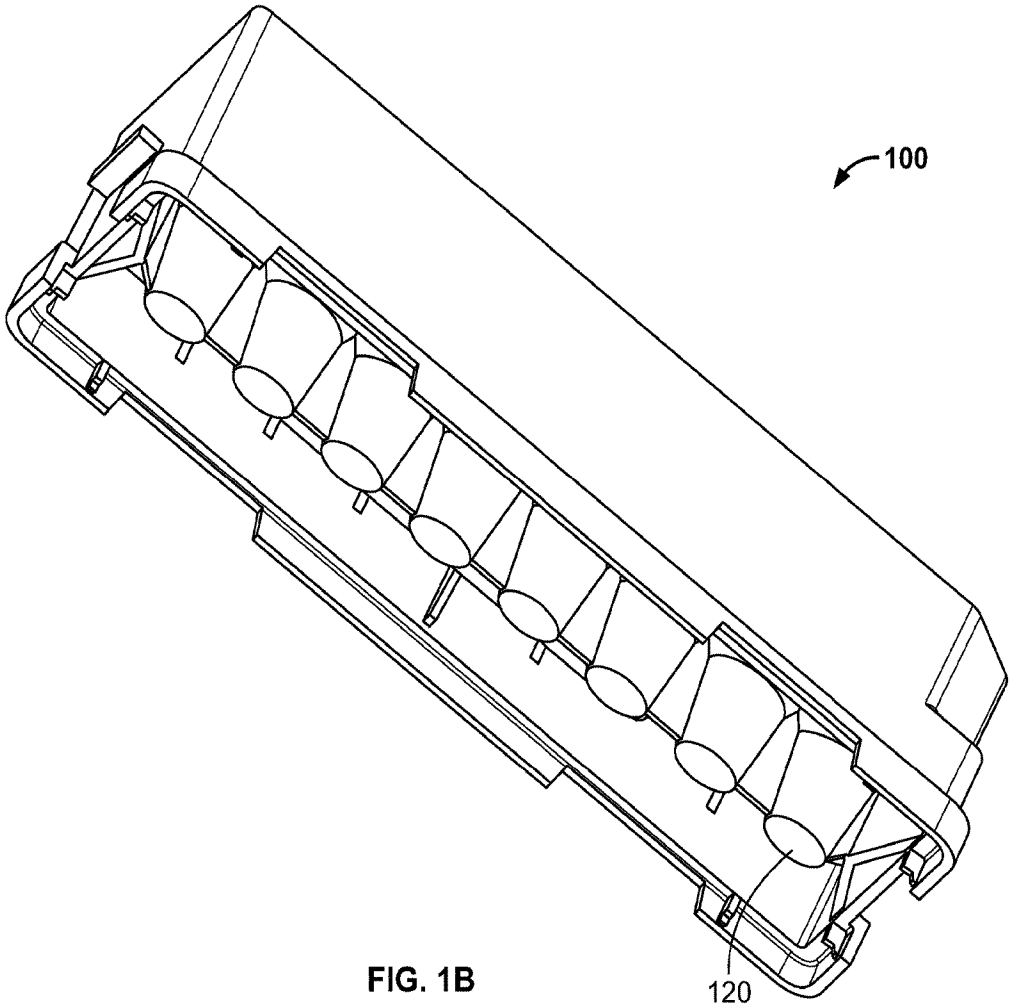

Referring to FIGS. 1*a* and 1*b*, a multiwell microplate 100 in accordance with an embodiment of the invention is formed from a frame 110 defining a single column of wells 120. The number of wells 120 in a plate may vary from two to thousands, preferably a maximum of 128 (corresponding to an industry standard of wellplates with 1536 wells, with 128 wells in a single column) In some embodiments, the multiwell microplate may have a column of four, six, or twelve wells. In a particular embodiment, the multiwell microplate has eight wells 120. A configuration with eight wells may be especially advantageous, as it allows up to four replicates of two conditions such as disease/normal, drug treated/native, or genetic knock-out vs. wild type, while maintaining a small footprint. Moreover, many analytical instruments are configured to handle well plates having columns of eight wells, such as 96 well plates (8×12).

In one embodiment, the multiwell microplate 100 includes a one-dimensional pattern of wells complying, in relevant part, with the pattern and dimensions of a microplate, as described by the American National Standards Institute and Society for Laboratory Automation and Screening standards, including Height Dimensions for Microplates (ANSI/SLAS 2-2005, Oct. 13, 2011); Well Positions for Microplates (ANSI/SLAS 4/2004, Oct. 13, 2011); and Footprint Dimensions for Microplates (ANSI/SLAS 1-2004, Oct. 12, 2011), all incorporated by reference herein.

The multiwell microplate may be formed from a molded plastic, such as polystyrene, polypropylene, polycarbonate, or other suitable material. The bottoms of the wells may be transparent and the sides colored black to reduce optical cross-talk from one well to another. In some embodiments, e.g., for use with luminescence measurements, the wells may be white. In some embodiments, e.g., for use in high-resolution imaging applications, the plate may be formed with glass as the bottom of the wells and plastic polymer forming the sides of the plate and walls of the wells.

Each of the wells may have a top portion with an opening having a length $l_1$ as well as a bottom portion that may be cylindrical or square, and may have a tapered sidewall. A seating surface may be provided to act as a positive stop for sensors disposed on barriers (see discussion of cartridge with respect to FIGS. 2*a* and 2*b*). This seating surface enables the creation of a localized reduced volume of medium, as discussed in U.S. Pat. No. 7,276,351, incorporated by reference herein. In an embodiment, the seating surface may be defined by a plurality of raised dots, e.g., three dots, on a bottom surface of a well. The well length $l_1$ can be any dimension and may be preferably selected from a range of 1 to 9 mm, e.g., 6 mm. Preferably, the wells are spaced equally from each other, e.g., 3-18 mm, more preferably 9 mm as measured center to center of the wells. Each of the wells in the microwell plate can have substantially the same dimensions, including the same well length $l_1$ as well as a width equal to the length. In some embodiments, however, the wells may have varying dimensions, including different well lengths $l_1$. A depth of the wells may range from 1 to 16 mm or more, preferably about 15 mm.

A moat 130 extends about an external perimeter of the wells. A plurality of walls 140 traverse the moat, the walls 140 defining a plurality of compartments 150. The walls 140 are preferably thick enough to provide rigidity to the microplate, while being thin enough to be injection molded without distortion. Accordingly, a thickness of the walls may range from 0.5 to 1.5 mm, preferably about 1 mm. The compartments each have a length $l_2$ that is preferably a multiple of $l_1$ and less than $6l_1$, preferably about $2l_1$, and not less than 6 mm. For example, if a well opening has a length $l_1$ of 9 mm, an abutting compartment may have a length of $2l_1$ of 18 mm. A length of less than 6 mm (9 mm well-to-well spacing) could make filling the compartments challenging. All of the compartments may have substantially equal longitudinal lengths, i.e., the length from one end wall to an opposing end wall varying no more than 25%.

In a preferred embodiment, the moat has eight compartments and eight wells, with one or more compartments having a length approximately equal to the sum of the lengths of approximately two well openings, plus a thickness of one or more walls defining the well openings.

Two compartments disposed on opposing sides of the single column of wells may be in fluidic communication via an equalizer channel 160. The moat may include two equalizer channels 160, one at each end of the multiwell microplate. To equalize the volumes of the compartments of the moat, a depth of two compartments in communication via the equalizer channel may be less than a depth of compartments adjacent thereto. In one preferred embodiment, the equalizer channel is disposed at an end of the multiwell microplate, and is 0.08 inches wide and 0.25 inches deep. The dimensions of the equalizer channel are preferably small enough to reduce the contribution of the channel width to the overall plate size but are wide enough to overcome surface tension and allow the chosen fluid to fill the channel. In a preferred embodiment, the channel has a feature 165 (e.g., surface tension breaker 165 as illustrated in FIG. 1*d*) that breaks the surface tension of the fluid allowing it to self-fill at a lower volume. Since sharp corners break the surface tension of the fluid, to stimlate fluid flow through the narrow opening of the equalizer channel, one or more sharp edges may be included.

A depth of at least one compartment may be less than a depth of one of the wells, e.g., the depth of the at least one compartment may be 50% or less than the depth of one of the wells.

A depth of a compartment proximate an end portion of the frame may be less than a depth of a compartment disposed closer to a center portion of the frame. In one preferred embodiment, to maintain a constant fluid height across all compartments with 800 μl in end compartments connected by an equalizer channel and 400 μl of fluid in the inner compartments, the inner compartments may be 0.055 inches deeper than the outer compartments.

The moat may have a width of at least 0.2 inches and no more than 0.5 inches, preferably approximately 0.265 inches. A moat that is too narrow could minimize the benefit of having a hydrating barrier between the wells and the dry outside air; whereas, a moat that is too wide could introduce the risk of sloshing and contamination of the assay wells.

All of the compartments may be of substantially equal length, e.g., varying no more than 25%.

Various features of the moat facilitate its filling with a multi-channel pipettor design for Society for Biomolecular Screening ("SBS") standard microplates. Suitable multi-channel pipettors include Eppendorf 3122000051 and Mettler-Toledo L8-200XLS+, available from Eppendorf AG and Mettler-Toledor International Inc., respectively. The walls defining compartments are positioned so as to not interfere with pipette tips on the multi-channel pipettor. Such multi-channel pipettors have a standard tip-to-tip spacing of 9 mm, so compartments of a moat preferably allow access of an equal number of pipet tips into each compartment. Equalizer channels at the ends allow fluid to be drawn from the side compartments, thereby enabling hydration fluids to surround the end wells. The compartments are preferably more than one well and less than six wells in length to reduce splashing of liquid out of the microwell plate or contamination of assay wells with hydration liquid. Finally, the moat depth is preferably 50% or less than the well depth to reduce the required volume of hydration liquid and to allow the use of a pipettor the same size as a cell pipettor.

A lifting tab 170 may defined on one or both end portions 190 of the frame. The lifting tab may have a length $l_3$ of 0.3 to 0.55 inches, e.g., 0.435 inches. The lifting tab facilitates lifting of the multiwell microplate and a cover or a microplate and a cartridge, without removing the cover or cartridge.

The lower edge of the frame may define one or more indents 180. The indents may be positioned at the ends and/or the sides of the frame. The incorporation of one or more indents provides stability for the frame when positioned in a carrier tray. Moreover, without the indents, the frame would sit higher in the carrier, which may prevent its use in different instrumentation. The height of one multiwell microplate is preferably about 0.5 to 0.9 inches, more preferably 0.685 inches (17.4 mm) without the carrier. Side-loading plate readers, for example, have plate access heights of 16 mm to 28 mm. The indent allows placement of the plates in the carrier with minimal added height (0 to 0.05 inches, i.e., 0 to 1 mm) In one preferred embodiment, the carrier adds less than 0.001 inches to the height of the plate.

The relative surface areas of fluids in the compartments and the wells are relevant for the impact of the moat on reducing evaporation in the wells. If the surface area of the fluid in the compartments is too small, the reduction of evaporation in the wells may be negligible. If the surface area of the fluid in the compartments is larger than necessary for the desired impact, the multiwell microplate may be less compact than necessary, and may present a challenge in filling the compartments with the same pipettes that are used for filling the wells.

Preferred embodiments may provide the surface areas and volumes when fluid is introduced into the wells and compartments indicated in Table 1. Embodiments of the invention include ranges of the preferred values of at least ±25% and greater; preferably the ratios of volumes and surface areas of the wells and compartments are substantially equal to the indicated values, i.e., ±50%. In one preferred embodiment, the difference between the two bottom-up measurements in the compartments for the cell culture and assay conditions is 0.055 inches. This difference in depth results in the fluid height of all compartments being at a constant depth relative to the top surface of the plate (i.e., 0.180 inches). This difference compensates for the equalizer channel.

TABLE 1

| | Maximum capacity | Cell culture | Assay |
|---|---|---|---|
| Depth of fluid in well (from bottom of well) | 0 inches | 0.200 inches | 0.340 inches |
| Depth of fluid in well (from top of plate) | 0.610 inches | 0.410 inches | 0.270 inches |
| Depth of fluid in inner compartment (from bottom of compartment) | 0.40 inches | 0.220 inches | 0.220 inches |
| Depth of fluid in inner compartment (from top of plate) | 0 inches | 0.180 inches | 0.180 inches |
| Depth of fluid in end compartment (from bottom of compartment) | 0.345 inches | 0.165 inches | 0.165 inches |
| Depth of fluid in end compartment (from top of plate) | 0 inches | 0.180 inches | 0.180 inches |
| Surface area of fluid in a well | 0.1014 $in^2$ | 0.0333 $in^2$ | 0.0825 $in^2$ |
| Total surface area of fluid in 8 wells | 0.8112 $in^2$ | 0.2664 $in^2$ | 0.6600 $in^2$ |
| Surface area in end (shallow) compartment | 0.4387 $in^2$ | 0.4272 $in^2$ | 0.4272 $in^2$ |
| Surface area in inner compartment | 0.1768 $in^2$ | 0.1723 $in^2$ | 0.1723 $in^2$ |
| Total surface area of compartments | 1.5846 $in^2$ | 1.5436 $in^2$ | 1.5436 $in^2$ |
| $in^2$ of compartment surface area per $in^2$ of well surface area | 1.9534 | 5.7942 | 2.3387 |
| Ratio of compartment surface area to well surface area | ~2:1 | ~6:1 | ~5:2 |
| Volume of fluid in well | 639 microliters ("μl") | 200 μl | 200 μl |
| Total volume of fluid in 8 wells | 5112 μl | 1600 μl | 1600 μl |
| Volume in compartments at each end (shallow), including equalizer channel | 2113 μl | 800 μl | 800 μl |
| Volume in inner compartment | 926 μl | 400 μl | 400 μl |
| Total volume in compartments | 7930 μl | 3200 μl | 3200 μl |

TABLE 1-continued

| | Maximum capacity | Cell culture | Assay |
|---|---|---|---|
| μl of compartment volume per μl of well volume | 1.551 | 2 | 2 |
| Ratio of compartment volume to well volume | ~3:2 | 2:1 | 2:1 |

Cartridge

Figure 2A:
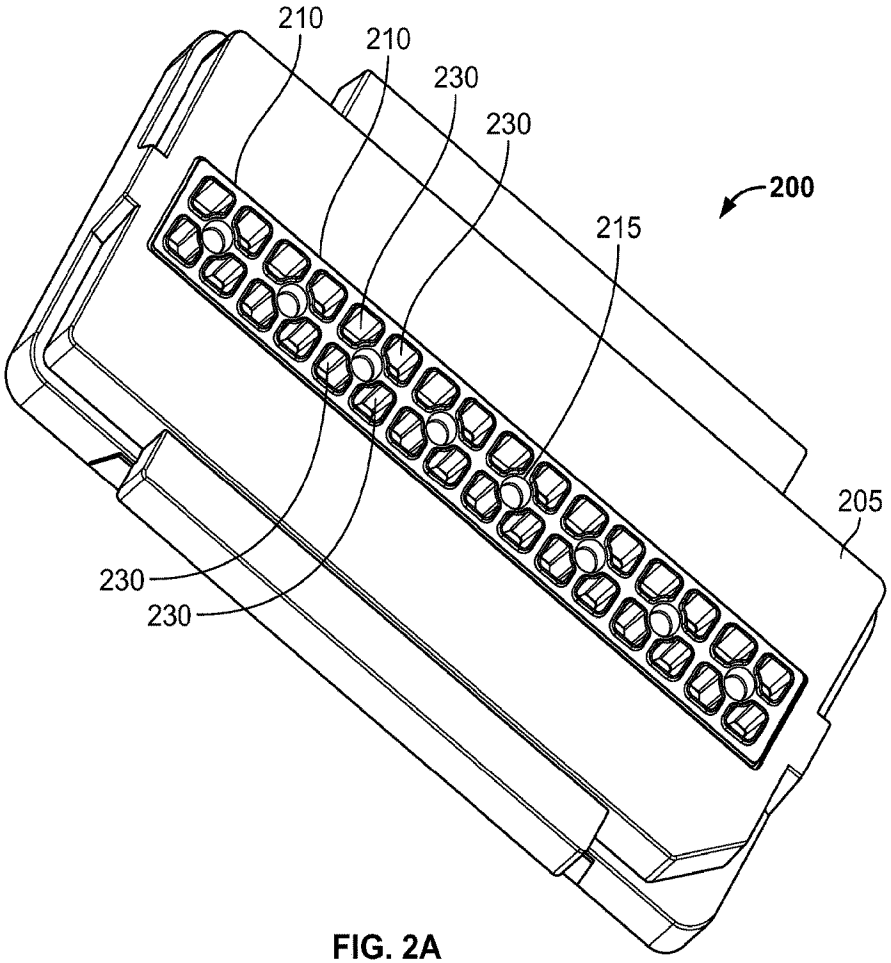
FIGS. 2*a* and 2*b* are upright and inverted (respectively) perspective views of a cartridge adapted to mate with the multiwell microplate of FIGS. 1*a* and 1*b* in accordance with one embodiment of the invention.
Figure 2B:
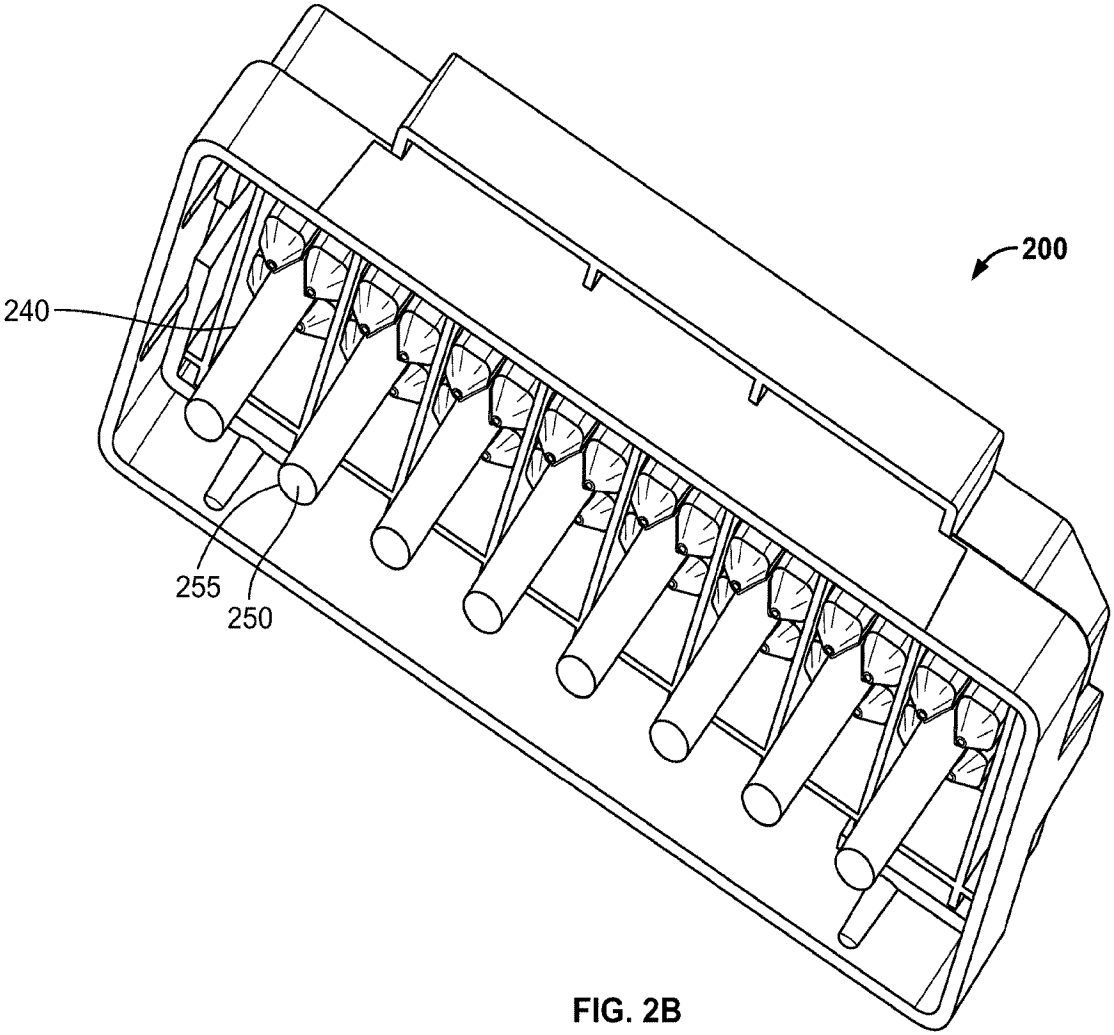

Referring to FIGS. 2*a* and 2*b*, a cartridge 200 is configured to mate with the multiwell microplate 100. The cartridge 200 has a generally planar surface 205 including a cartridge frame made, e.g., from molded plastic, such as polystyrene, polypropylene, polycarbonate, or other suitable material. Planar surface 205 defines a plurality of regions 210 that correspond to, i.e., register or mate with, a number of the respective openings of a plurality of wells 120 defined in the multiwell microplate 100. Within each of these regions 210, in the depicted embodiment, the planar surface defines first, second, third, and fourth ports 230, which serve as test compound reservoirs, and a central aperture 215 to a sleeve 240. Each of the ports is adapted to hold and to release on demand a test fluid to the respective well 120 beneath it. The ports 230 are sized and positioned so that groups of four ports may be positioned over each well 120 and test fluid from any one of the four ports may be delivered to a respective well 120. In other embodiments, the number of ports in each region may be less than four or greater than four. The ports 230 and sleeves 240 may be compliantly mounted relative to the multiwell microplate 100 so as to permit them to nest within the microplate by accommodating lateral movement. The construction of the cartridge to include compliant regions permits its manufacture to looser tolerances, and permits the cartridge to be used with slightly differently dimensioned microplates. Compliance can be achieved, for example, by using an elastomeric polymer to form planar element 205, so as to permit relative movement between the frame 200 and the sleeves and ports in each region.

Each of the ports 230 may have a cylindrical, conic or cubic shape, open at planar surface 205 at the top and closed at the bottom except for a small hole, i.e., a capillary aperture, typically centered within the bottom surface. The capillary aperture is adapted to retain test fluid in the port, e.g., by surface tension, absent an external force, such as a positive pressure differential force, a negative pressure differential force, or alternatively a centrifugal force. Each port may be fabricated from a polymer material that is impervious to test compounds, or from any other suitable solid material, e.g., aluminum. When configured for use with a multiwell microplate 100, the liquid volume contained by each port may range from 500 μl to as little as 2 μl, although volumes outside this range can be utilized.

Referring to FIG. 2*b*, in each region of the cartridge 200, disposed between and associated with one or more ports 230, is the submersible sensor sleeve 240 or barrier, adapted to be disposed in the corresponding well 120. Sensor sleeve 240 may have one or more sensors 250 disposed on a lower surface 255 thereof for insertion into media in a well 120. One example of a sensor for this purpose is a fluorescent indicator, such as an oxygen-quenched fluorophore, embedded in an oxygen permeable substance, such as silicone rubber. The fluorophore has fluorescent properties dependent on the presence and/or concentration of a constituent in the well 120. Other types of known sensors may be used, such as electrochemical sensors, Clark electrodes, etc. Sensor sleeve 240 may define an aperture and an internal volume adapted to receive a sensor.

The cartridge 200 may be attached to the sensor sleeve, or may be located proximal to the sleeve without attachment, to allow independent movement. The cartridge 200 may include an array of compound storage and delivery ports assembled into a single unit and associated with a similar array of sensor sleeves.

Figure 3:
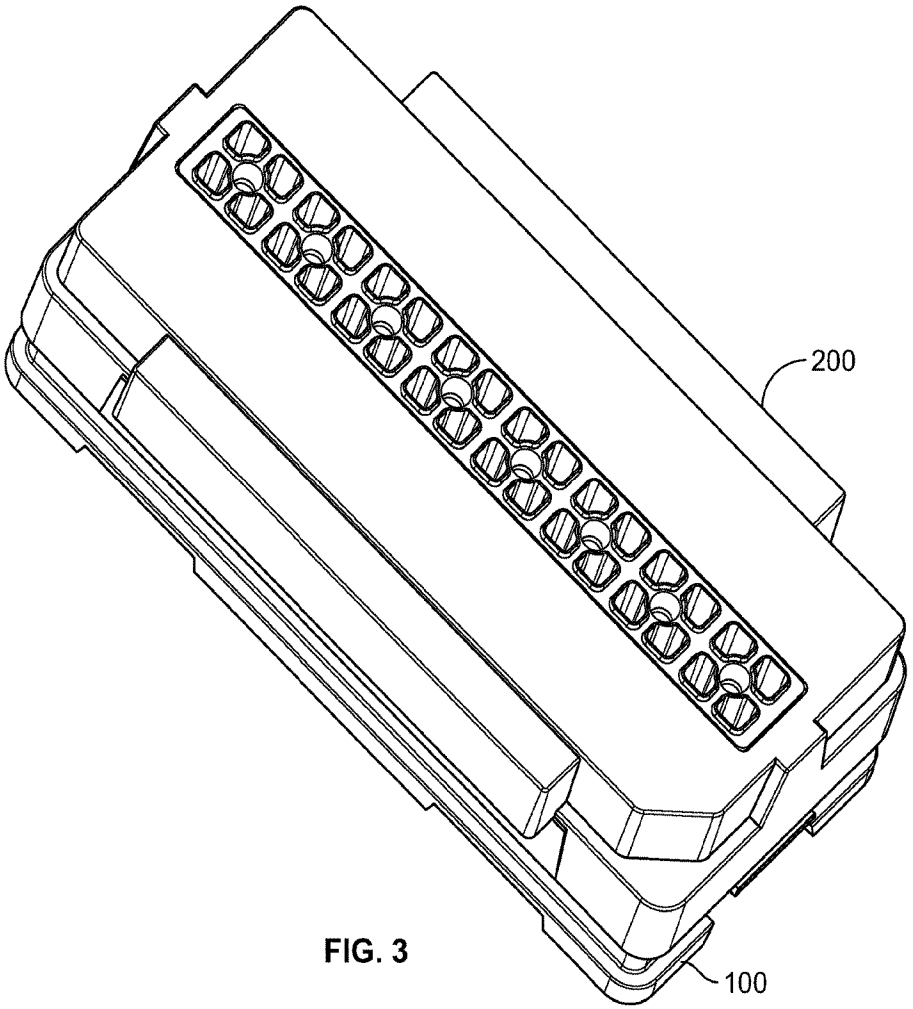

Referring to FIG. 3, the cartridge 200 is sized and shaped to mate with multiwell microplate 100. Accordingly, in an embodiment in which the microplate has eight wells, the cartridge has eight sleeves.

Cover

Figure 4:
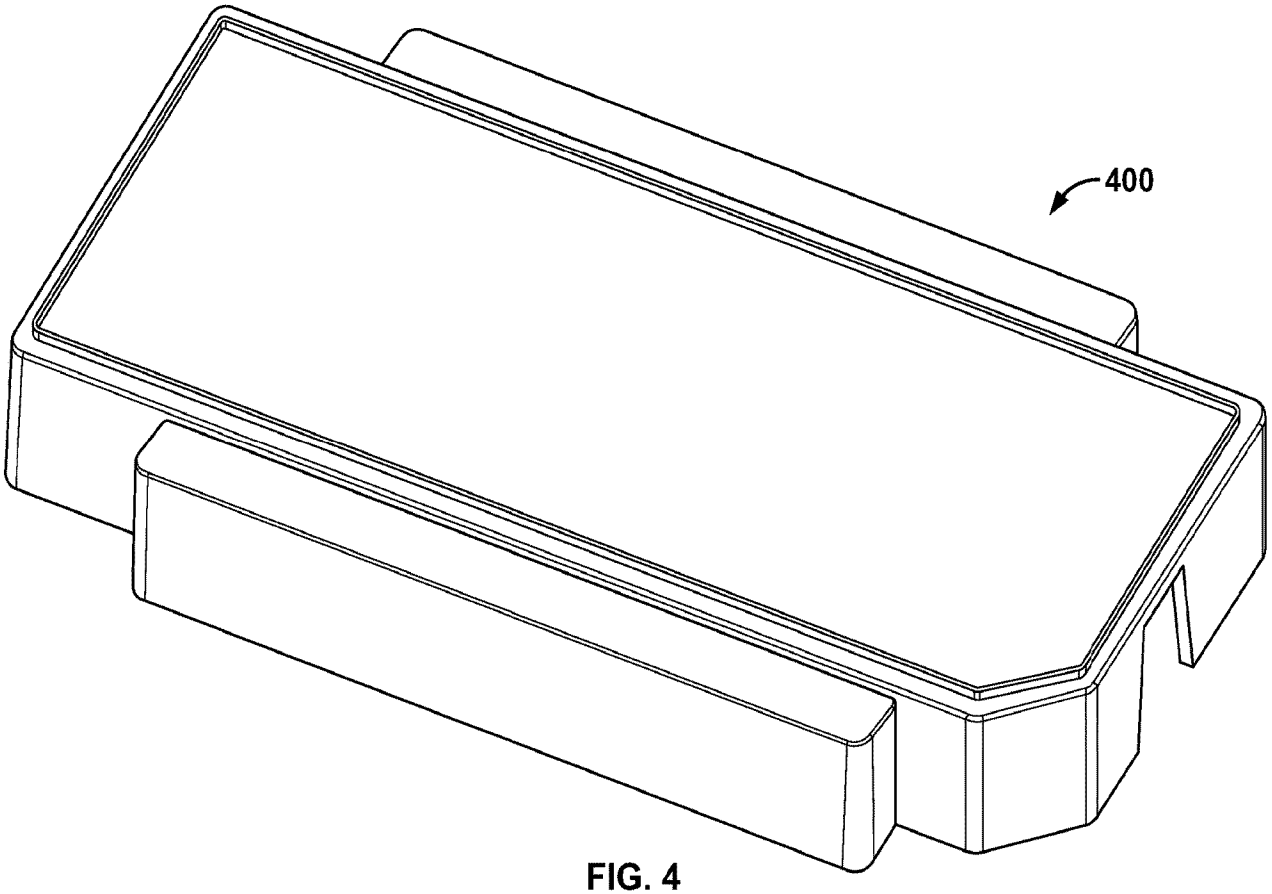

Referring to FIG. 4, the apparatus may also feature a removable cover 400 for the cartridge 200 and/or for the multiwell microplate 100. The cover 400 may be configured to fit over the cartridge 200, thereby to reduce possible contamination or evaporation of fluids disposed in the ports 230 of the cartridge. The cover 400 may also be configured to fit directly over the multiwell microplate 100, to help protect the contents of the wells and compartments when the microplate 100 is not in contact or mated with the cartridge 200.

Carrier Tray

Figure 5A:
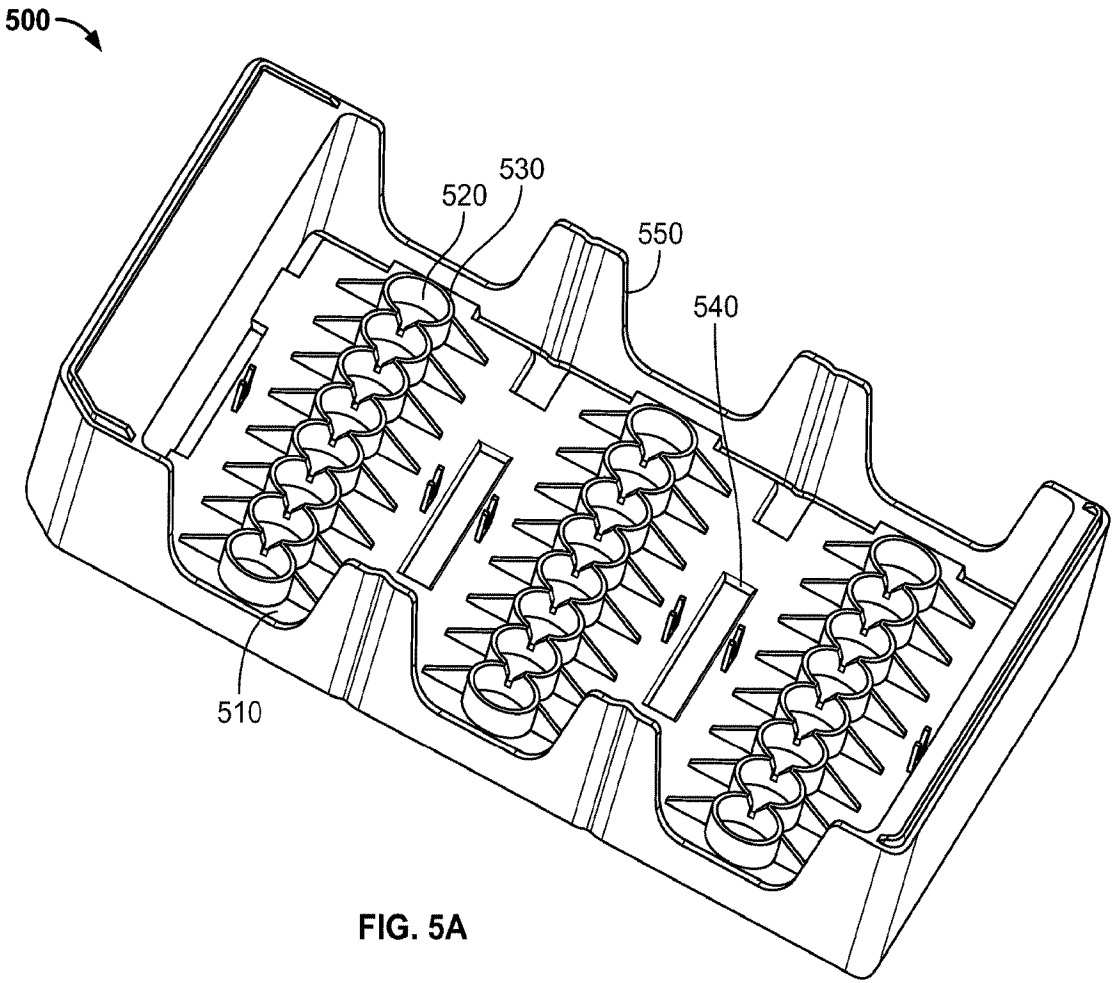
FIG. 5*a* is a perspective view of a carrier tray in accordance with an embodiment of the invention.
Figure 5B:
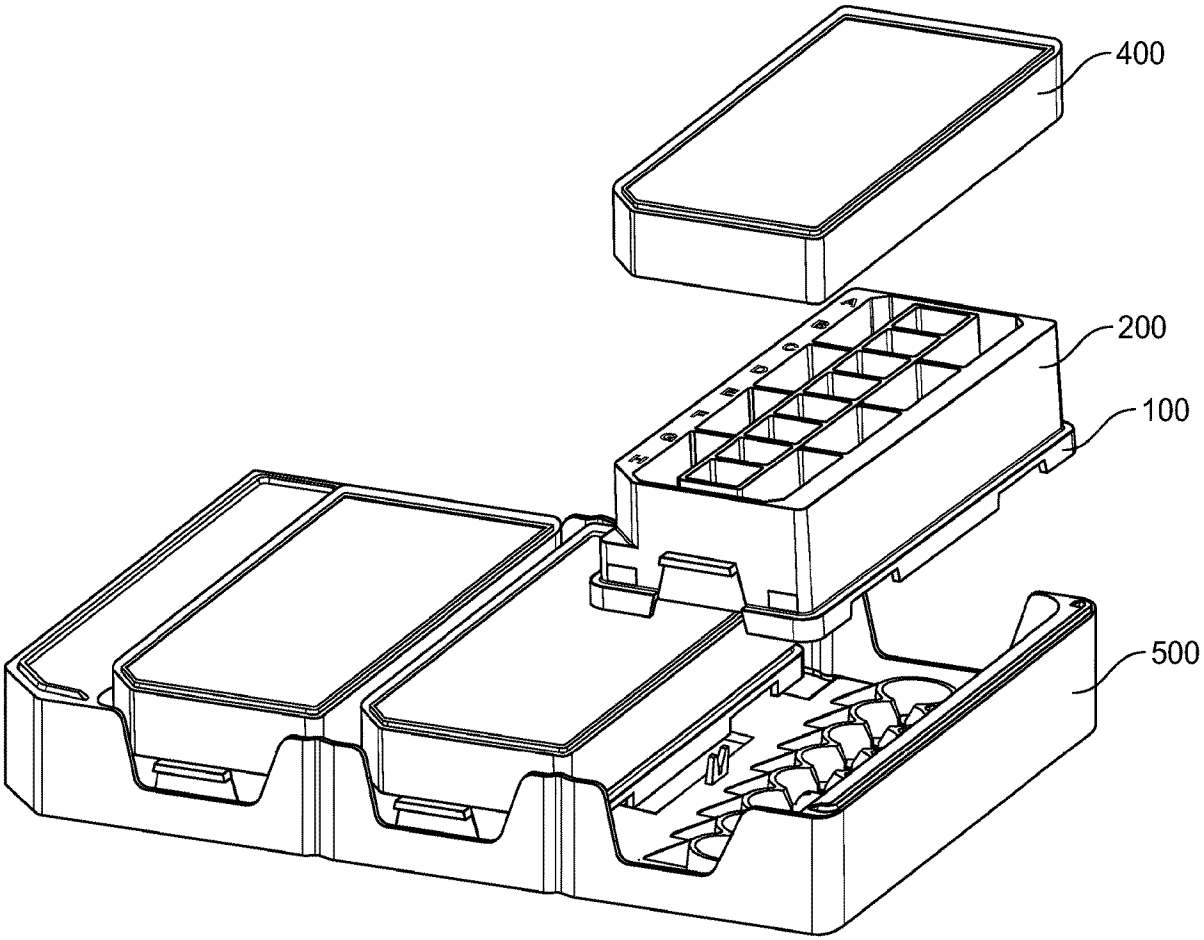
FIG. 5*b* is a perspective view of a carrier tray in combination with three multiwell microplates and covers, in accordance with an embodiment of the invention.

Referring to FIGS. 5*a* and 5*b*, a multiwell microplate carrier tray 500 allows several, e.g., three or four, single-column multiwell microplates to be placed and measured in an instrument designed for 96 well standard microplates that comply with standard ANSI/SLAS 1-2004. Accordingly, the carrier tray may have outer dimensions of 5.0299 inches±0.0098 inches by 3.3654 inches±0.0098 inches, i.e., about 5 by 3 inches or about 127 mm×84 mm. In other embodiments, the outer dimensions of the carrier tray may be scaled, depending upon the number of wells in the single-column microplates and the instrument in which measurements may be carried out.

In one preferred embodiment, the carrier has three regions 510 defining a plurality of openings 520 configured to align and mate with the wells of each multiwell microplate 100. In one preferred embodiment, in use, the columns of wells of the multiwell microplates are disposed at positions that correspond to columns 3, 7, and 11 of a 96-well microplate. Since the wells of the disclosed multiwell microplates are located at positions defined by the ANSI/SLAS standard, no modification of the plate readers is required. A collar 530 surrounds the bottom region of each microplate well when installed in the cartridge. Each collar forms a circular opening that provides positioning as well as light blockage. The collar may be colored black to shield crosstalk light from fluorescent signaling molecules in wells, or may be white to amplify emitted light from luminescent markers. The carrier may include slots 540 that correspond to indents on the multiwell microplate. The skirts of two adjacent microplates may fit into each slot. Scalloped edges 550 enable a user to easily remove the microplates as necessary, while providing rigidity to the carrier.

In one preferred embodiment, the carrier openings allow the microplate to sit in the carrier at the same height as if the plate was not in the carrier, i.e., the height of the plate is equal to the height of the plate and carrier assembly.

Cartridges 200 and covers 400 may be placed over the microplates 100, as discussed above. The multiwell microplates and cartridges may generally be used as described in U.S. Pat. Nos. 7,276,351 and 8,658,349, incorporated by reference herein. Moreover, the individual wells, barriers, and ports may have any of the characteristics and features of the wells, barriers, and ports described in these patents.

In use, a liquid analytical sample may be prepared by delivering the analytical sample to a well defined by a frame of a multiwell microplate 100, and delivering a fluid to a moat 130 defined by the frame. The analytical sample may be, for example, cells in a media. The fluid may be the same media, or another liquid, such as water. Both the analytical sample and the fluid may be delivered by a pipettor; in some embodiments, the sample and the fluid may be delivered by the same pipettor.

EXAMPLES

Example 1

Incubator evaporation experiments were run to compare evaporation in covered multiwell microplates with hydration fluid in moats and without such fluid. For each of six plates, 80 microliters of liquid was placed in each well, and for three of those plates, 400 microliters of liquid was placed in each compartment of the moat. Three multiwell microplates with covers but with no liquid in moats ("dry") and three multiwell microplates with covers and with liquid in moats were incubated overnight in a humidified incubator at 37° C. in a 10% $CO_2$ atmosphere. The volume of liquid remaining in each well was measured, and the following values determined.

10% $CO_2$ Incubator Testing

| | With Moat | Without Moat |
|---|---|---|
| Average Volume Remaining (microliters) | 76.4 | 74.0 |
| Average Volume Lost (microliters) | 3.6 | 6.0 |
| % Lost | 4.5% | 7.5% |

Example 2

Figure 6:
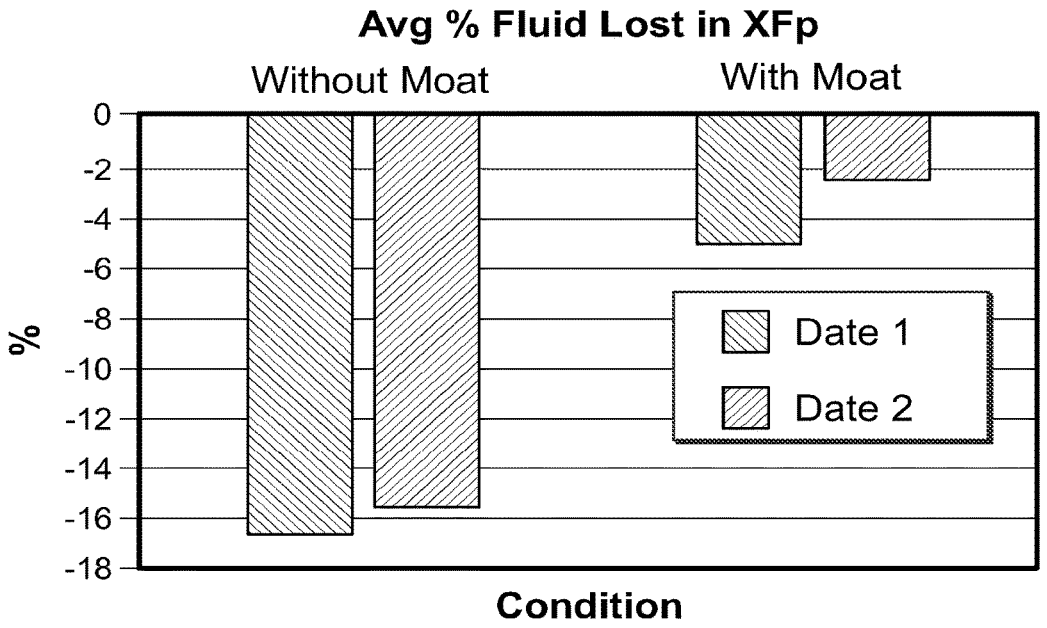

Evaporation of liquid from wells in uncovered microwell plates was measured after conducting a mock assay (~90 minutes) within an extracellular flux analyzer instrument. Referring to FIG. 6, the average % of fluid lost in a microwell plate with a filled moat was 3.75%, whereas about 15.8% of fluid was lost in a microwell plate with an empty moat. Evaporation is preferably reduced, as it causes variations in assay data due to changes in temperature as well as the ionic strength of the cell media.

Example 3

Referring to FIG. 7, cells disposed in media were observed with hydration fluid in moats and without hydration fluid. Key metabolic parameters of oxygen consumption rate (OCR) and extracellular acidification rate (ECAR) were monitored in each well. The well-to-well variability in plates with dry moats (CV 60-95%) was considerably higher than the variability observed for assay wells in plates with filled moats (20-65%). Low well-to-well variability of both the OCR and ECAR signals is required for good assay performance. The OCR measurement is particularly sensitive to temperature variations which can be caused by varying rates of evaporation in assay wells not protect by fluid-filled moats.

Example 4

Figure 8A:
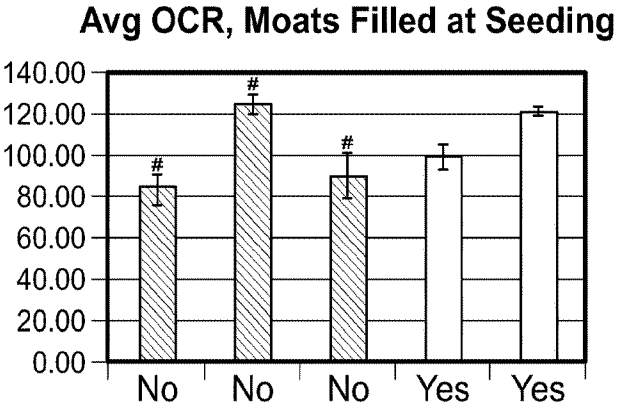
FIGS. 8*a*-8*d* are bar charts of baseline metabolic rates (OCR and ECAR) of C2C12 cells measured under several conditions to test the effect of the moat of a microplate being filled or empty in accordance with an embodiment of the invention.
Figure 8B:
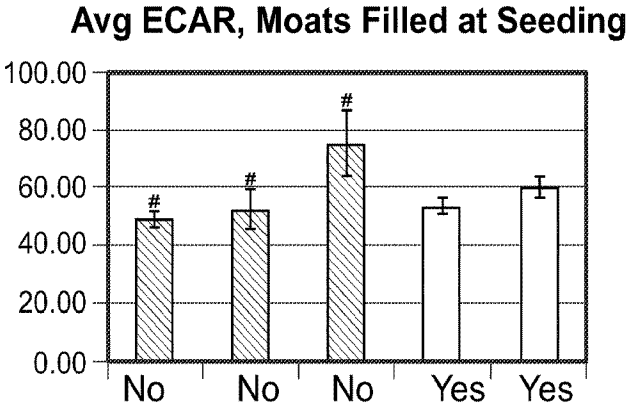
Figure 8C:
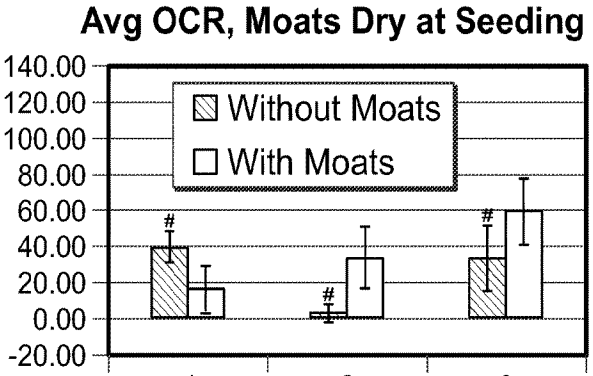
Figure 8D:
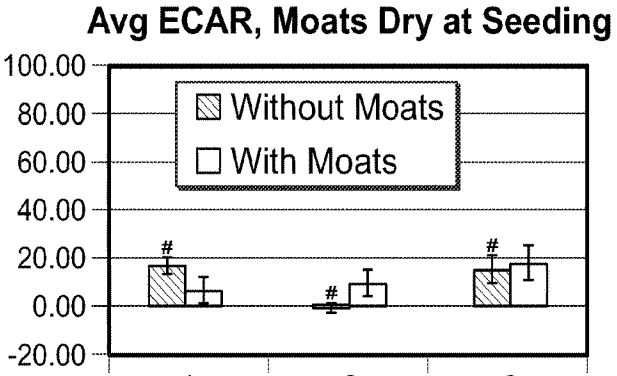

Referring to FIGS. 8*a*-8*d*, baseline metabolic rates (OCR and ECAR) of C2C12 cells seeded at equal densities were measured under several conditions to test the effect of the moat being filled or empty. In FIGS. 8*a* and 8*b*, the moat was filled as prescribed (400 μl per compartment) at the time of cell seeding. For plates represented by hashed bars, the moats were emptied prior to performing the assay in the XF instrument. In FIGS. 8*c* and 8*d*, the cells were seeded and incubated overnight without placing fluid in the moats. In C and D plates represented by solid bars had fluid added to the moats prior to running the experiment. Both OCR and ECAR were measured for all plates. To assess the effect of the presence of fluid in the moats at the time of seeding on the OCR measurement, FIG. 8*a* is compared to FIG. 8*c*. Cells seeded in plates with fluid in the moats had OCR values in the range of 80-120, whereas cells seeded in plates with dry moats had OCR values in the range of 0-60. OCR is a measure of the metabolic health of the cells. Low OCR values indicate that the cells were not metabolically active. Similar results are seen when comparing FIGS. 8*b* and 8*d* for the ECAR measurement. When cells are seeded in plates and the moat is not filled, the metabolic rate as measured by ECAR is also very low, indicating poor cell health. Thus, it is shown that the presence of fluid in the moats at the time of cells seeding and overnight incubation is an important requirement for good cell health in the single-column microplate.

Example 5

Figure 9A:
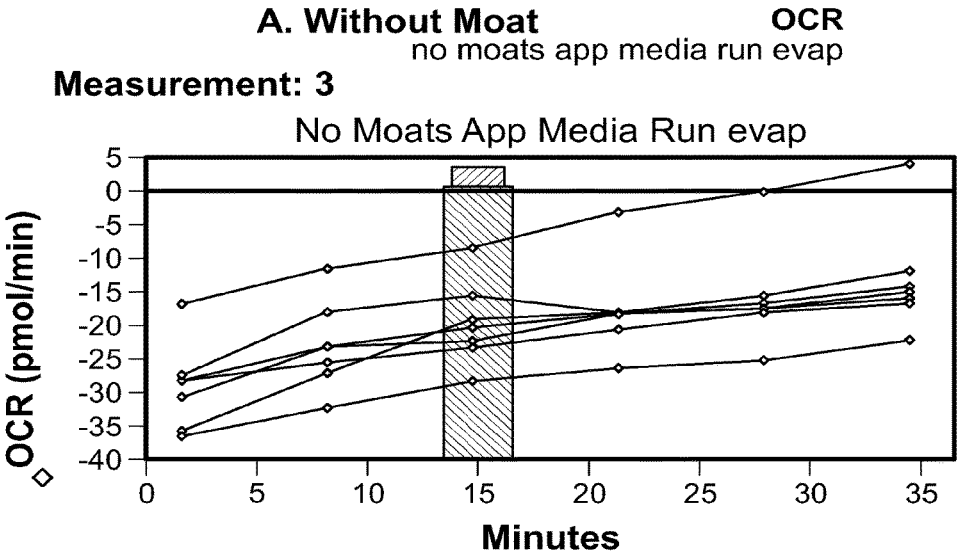
FIGS. 9*a* and 9*b* are graphs illustrating inter- and intra-well variability of the background OCR signal over time in multiwell microplates in accordance with embodiments of the invention.
Figure 9B:
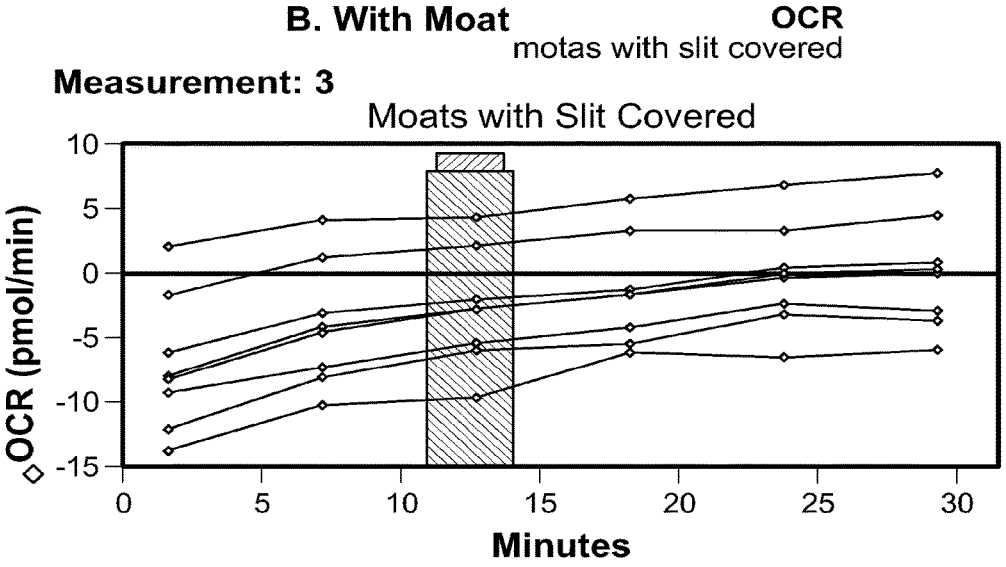

Referring to FIGS. 9*a* and 9*b*, inter- and intra-well variability of the background OCR signal over time was compared in a plate without fluid in the moat to a plate with fluid in the moat. For each plate tested, media was placed in each well, the plate was allowed to equilibrate in the instrument for 15 minutes, then measurements were made over 30 minutes. In the plate without fluid in the moat, the background OCR signal varied significantly from well to well, ranging from −37 to +5 (range of 42) and rising 10-20 units over the 30 minute period. When the moat was filled, the signal was much more stable with an overall range of −14 to +7 (range of 21) and rising about 7 units over the time period. Thus it is shown that the presence of fluid in the moats is required for stable background levels in this assay.

The invention may be embodied in other specific forms without departing from the spirit or essential characteristics thereof. The foregoing embodiments are therefore to be considered in all respects illustrative of the invention described herein. Various features and elements of the different embodiments can be used in different combinations and permutations, as will be apparent to those skilled in the art. Scope of the invention is thus indicated by the appended claims rather than by the foregoing description, and all changes which come within the meaning and range of equivalency of the claims are therefore intended to be embraced herein.

What is claimed is:

1. A multiwall microplate for holding liquid samples, the multiwell microplate comprising:

a frame defining a plurality of wells disposed in a single column, each well, having an opening with a length $l_1$;

a moat comprising a plurality of compartments and equalizer channels at each end of the multiwell microplate; and a plurality of walls traversing the moat, the walls defining the plurality of compartments of the moat, each compartment having a length $l_2$ selected from a range of greater than $l_1$ and less than $6l_1$, wherein the single column has at least two side walls, and at least two of the compartments are disposed on the at least two side walls of the single column of wells, and wherein at least two of the compartments are in fluidic communication via the equalizer channel and the equalizer channels connect compartments disposed on opposing side wails of the column.

2. The multiwell microplate of claim 1, wherein the well length $l_1$ is selected from a range of 1 mm to 9 mm.

3. The multiwell microplate of claim 1, wherein the plurality of wells comprises eight wells.

4. The multiwell microplate of claim 1, wherein the moat comprises eight compartments.

5. The multiwell plate of claim 1, wherein a depth of the two compartments in communication via the equalizer channel is less than a depth of compartments adjacent thereto.

6. The multiwell microplate of claim 1, Wherein a depth of at least one compartment is less than a depth of one of the wells.

7. The multiwell microplate of claim 6, wherein the depth of the at least one compartment is up to 50% of the depth of one of the wells.

8. The multiwell microplate of claim 1, wherein a depth of a compartment proximate an end portion of the frame is less than a depth of a compartment disposed at a center portion of the frame.

9. The multiwell microplate of claim 1, wherein all of the compartments have a substantially equal length.

10. The multiwell microplate of claim 1, further comprising a filling tab defined on an end portion of the frame.

11. The multiwell microplate of claim 1, wherein at least one well is opaque white.

12. The multiwell microplate of claim 1, wherein at least one well is opaque black.

13. The multiwell microplate of claim 1, the frame further comprising an indent on a lower edge thereof.

* * * * *